US009507292B2

(12) United States Patent
Kawasumi

(10) Patent No.: US 9,507,292 B2
(45) Date of Patent: Nov. 29, 2016

(54) DEVELOPING DEVICE

(71) Applicant: CANON KABUSHIKI KAISHA, Tokyo (JP)

(72) Inventor: Ryoichi Kawasumi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/859,804

(22) Filed: Sep. 21, 2015

(65) Prior Publication Data

US 2016/0085178 A1 Mar. 24, 2016

(30) Foreign Application Priority Data

Sep. 24, 2014 (JP) ..... 2014-193627

(51) Int. Cl.
*G03G 15/08* (2006.01)

(52) U.S. Cl.
CPC ..... *G03G 15/0882* (2013.01); *G03G 15/0841* (2013.01); *G03G 2221/1657* (2013.01)

(58) Field of Classification Search
CPC ..... G03G 15/0881; G03G 15/0882; G03G 2215/0877; G03G 2215/088
See application file for complete search history.

(56) References Cited

U.S. PATENT DOCUMENTS

| | | | | |
|---|---|---|---|---|
| 8,818,245 | B2 | 8/2014 | Takaya et al. | |
| 8,855,525 | B2 | 10/2014 | Muto et al. | |
| 8,989,633 | B2 | 3/2015 | Nakajima | |
| 2002/0012546 | A1* | 1/2002 | Chanadi | G03G 21/1647 399/106 |
| 2002/0031368 | A1* | 3/2002 | Kanno | G03G 21/1814 399/103 |
| 2005/0053393 | A1* | 3/2005 | Harada | G03G 15/0855 399/106 |
| 2011/0286768 | A1 | 11/2011 | Muto et al. | |
| 2013/0121721 | A1* | 5/2013 | Horikawa | G03G 15/0877 399/106 |

FOREIGN PATENT DOCUMENTS

| | | | |
|---|---|---|---|
| EP | 1 030 228 | A3 | 8/2009 |
| JP | 2004-206088 | A | 7/2004 |
| JP | 2011-197442 | A | 10/2011 |
| JP | 2011-242639 | A | 12/2011 |
| JP | 2012-226128 | A | 11/2012 |

OTHER PUBLICATIONS

European Search Report received Mar. 23, 2016, in related European Patent Application No. 15184796.9.

* cited by examiner

*Primary Examiner* — Sandra Brase
(74) *Attorney, Agent, or Firm* — Fitzpatrick, Cella, Harper & Scinto

(57) ABSTRACT

A developing apparatus is detachably mountable to an image forming apparatus and includes a developer container for accommodating a developer, a sealing member configured to unsealably seal the developer container to retain an initial developer therein, and a disconnecting mechanism to disconnect a drive of a driven member to unseal the developer container. The disconnecting mechanism includes a driving train having a first gear engaged with a driving gear configured to drive a feeding member, a worm gear engaged with the first gear, and a second gear configured to drive the driven member, and a holder configured to support the driven train so as to be integrally swingable about a rotational axis of the driving gear while keeping relative positions between the first gear, the worm gear and the second gear, wherein the disconnecting mechanism disengages between the first gear and the driving gear.

11 Claims, 15 Drawing Sheets

DEVELOPING DEVICE

FIELD OF THE INVENTION AND RELATED ART

The present invention relates to a developing device which develops an electrostatic latent image formed on the peripheral surface of an image forming component, into a visible image, by an electrophotographic recording method, an electrostatic recording method, or the like.

An image forming apparatus which uses an electrophotographic recording method, an electrostatic recording method, or the like forms a toner image by forming a latent image on the peripheral surface of its image bearing member such as a photosensitive drum, and developing this latent image into a toner image with the use of toner. As a developing device for developing a latent image with the use of toner as described above, a developing device which has the first and second chambers, and frictionally charges toner by recirculating a mixture of toner and carrier between the two chambers, has been known. Further, it conveys toner to the area of contact between the photosensitive drum, and a development sleeve disposed in the second chamber, by causing the development sleeve to bear developer, so that the latent image on the peripheral surface of the photosensitive drum is developed by the toner.

A developing device such as the above-described one has been proposed (Japanese Laid-open Patent Application 2011-242639, for example). According to this patent application, the developing device is structured so that the initial supply of developer is stored in the first chamber, and the passages between the first and second chambers are kept sealed with a sealing sheet to keep the developer sealed in the first chamber, in order to prevent the initial supply of developer from scattering out of the developing device during the shipment of the developing device.

In the case of a developing device such as the one described above, toner is consumed for development, but the carrier is hardly consumed. That is, most of the carrier remains in the developing device. Thus, the carrier in the developing device gradually deteriorates as the developing device increases in the cumulative length of its usage. That is, the carrier reduces in charging performance. Thus, a developing device of the so-called trickle replenishment type has been known, which is not only replenished with a fresh supply of developer, but also, is made to discharge the excess amount of developer, which includes the deteriorated carrier, through its developer outlet (Japanese Laid-open Patent Application 2011-197442, for example).

In recent years, not only has it been desired to reduce the length of time it takes to set up an image forming apparatus, but also, to shorten the process for setting the apparatus up, in order to appease a user. One of the methods for accomplishing these objectives is to install all the removably installable units such as developing devices in the main assembly of an image forming apparatus before the apparatus is shipped out from a factory, in order to make it possible for a user to instantly start up the apparatus simply by connecting the apparatus to an electric power source and turning it on.

According to the above-mentioned first patent document, the sealing sheet is wound away by the driving force inputted into the developing device to connect the first and second chambers to each other. Further, in the case of a developing device such as the one disclosed in the above-mentioned second patent document, which is provided with an outlet for discharging the excess amount of developer, it is also possible to keep the developer discharge outlet sealed with the use of a sealing member, in order to prevent developer from leaking while the device is shipped. Also in this case, it is possible to remove the sealing sheet by the force inputted to the developing device to open the developer discharge outlet.

In a case where a sealing member such as a sealing sheet is removed by the driving force inputted into the developing device, unless the means for removing the sealing member is not disengaged from the driving force source, the sealing member removing member continues to be driven even after the removal of the sealing member, as long as the developing device is driven. If the sealing member removing means continues to be driven by the force inputted into the developing device, it is possible that vibrations and the like will be transmitted to the driving force transmission path, and therefore, it is possible that the image forming apparatus will output unsatisfactory images.

SUMMARY OF THE INVENTION

The present invention was made in consideration of the above-described issues. Thus, the primary object of the present invention is to provide a developing device structured so that it is significantly shorter in startup procedure than any conventional developing device, and also, so that it contribute to the occurrence of image defects According to an aspect of the present invention, there is provided a developing apparatus comprising a developer container for accommodating a developer; a sealing member configured to unsealably seal said developer container to retain an initial developer therein; a driven member configured to receive a drive to unseal said developer container; a feeding member configured to feed the developer in said developer container; a developer carrying member configured to develop a latent image with a developer carried on a surface thereof; a motor configured to drive said feeding member or said developer carrying member; a disconnecting mechanism configured to disconnect the drive to said driven member, said disconnecting mechanism being movable between a drive transmission position in which the drive is capable of being transmitted from said motor to said driven member and a non-driving position in which the drive is not transmitted from said motor; said disconnecting mechanism including an urging member configured to urge said disconnecting mechanism toward the non-driving position; and a holding mechanism capable of holding said disconnecting mechanism in the drive transmission position, wherein said holding mechanism is movable from a position for holding said disconnecting mechanism in the drive transmission position to a position for releasing said disconnecting mechanism from the drive transmission position, by a drive from said disconnecting mechanism placed in the drive transmission position.

Further features of the present invention will become apparent from the following description of exemplary embodiments (with reference to the attached drawings).

Figure 5:
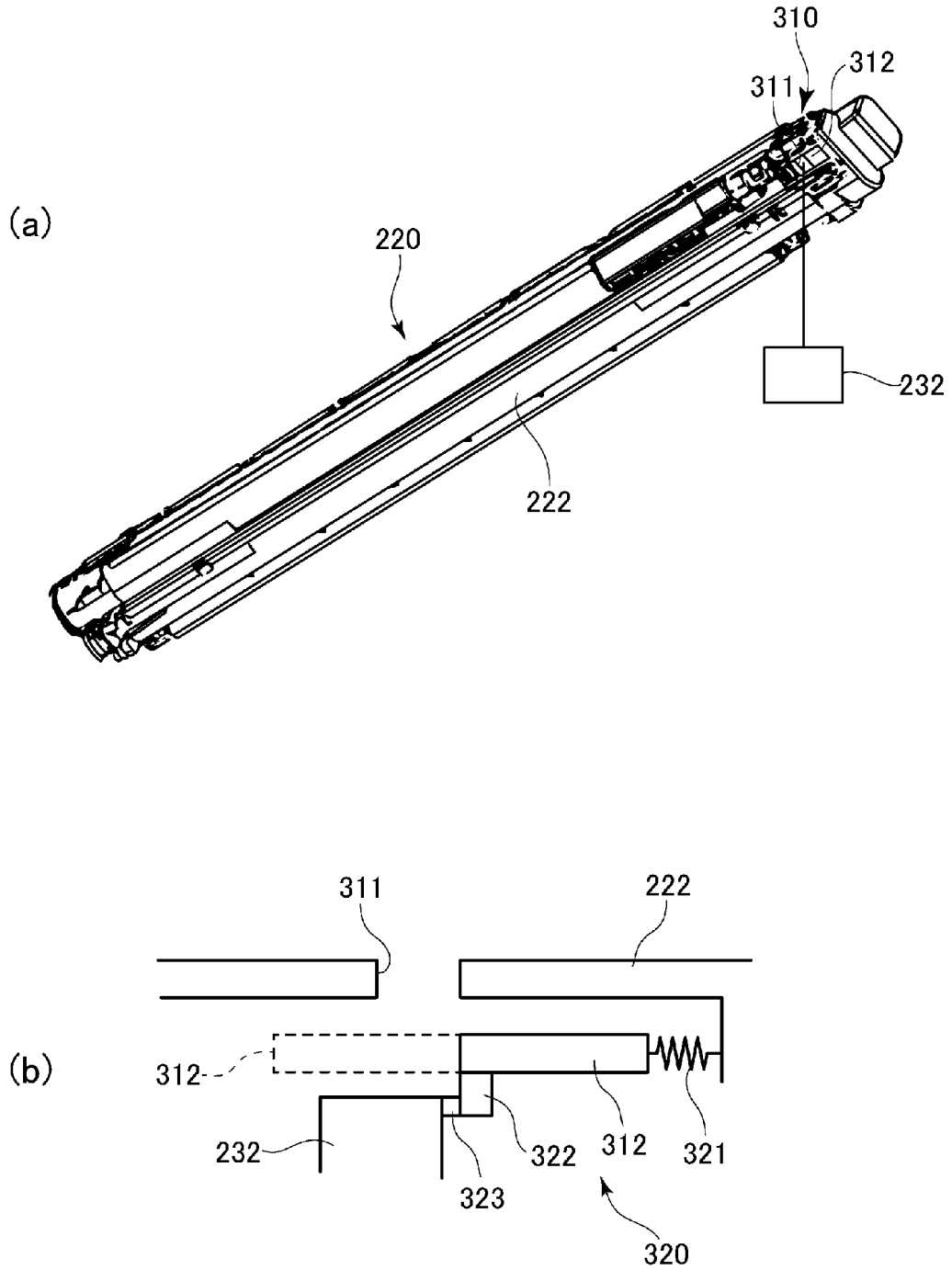

Part (a) of FIG. 5 is a perspective view of the developing device in the first embodiment as seen from the bottom side of the device. Part (b) of FIG. 5 is a schematic drawing of the developer outlet shutter and its adjacencies, and shows the portion of the structure of the device, which is for opening or closing the shutter.

Figure 6:
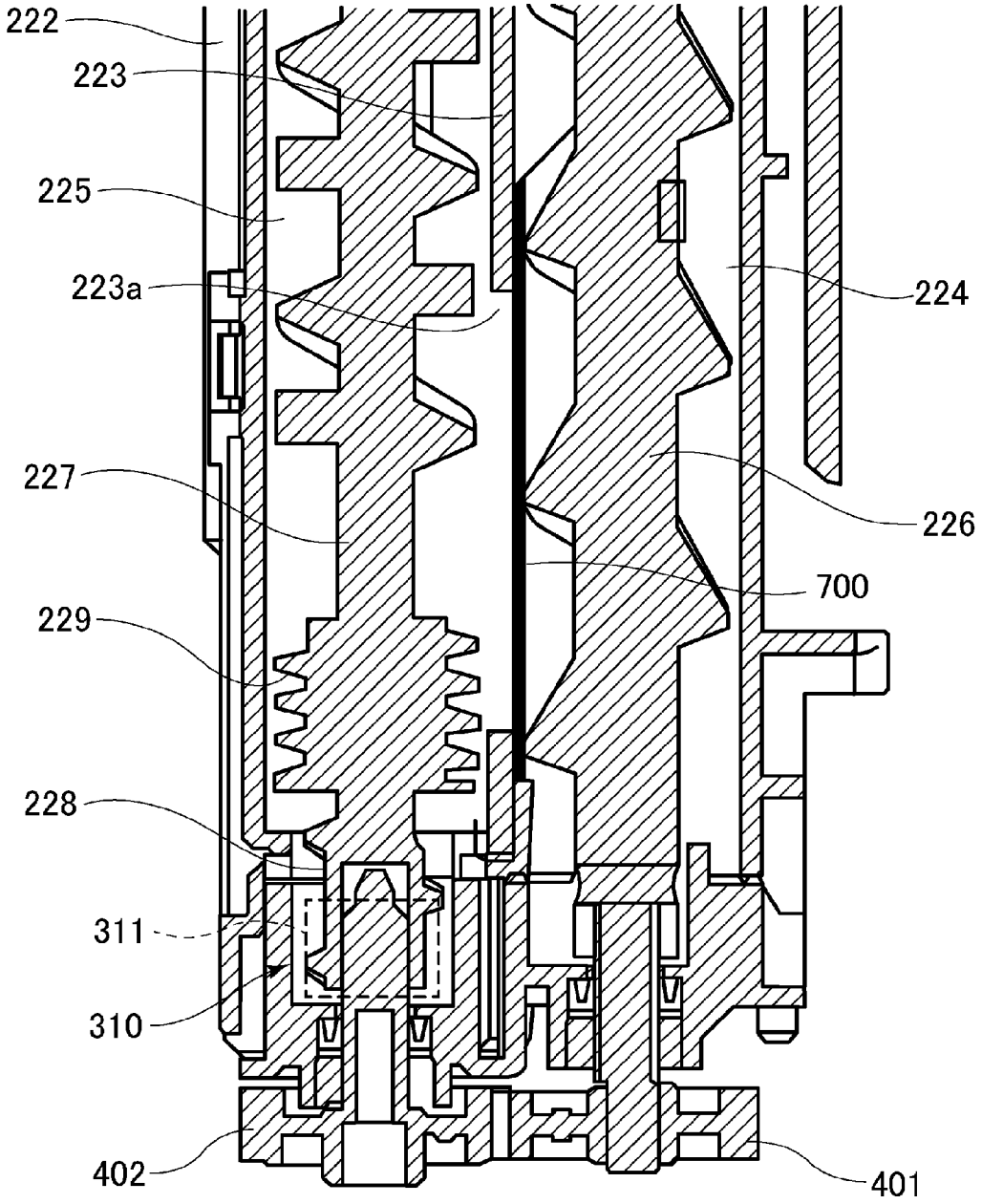

FIG. 6 is an enlarged vertical cross-sectional view of the adjacencies of one of the developer passages between the two chambers of the developing device in the first embodiment.

Figure 7:
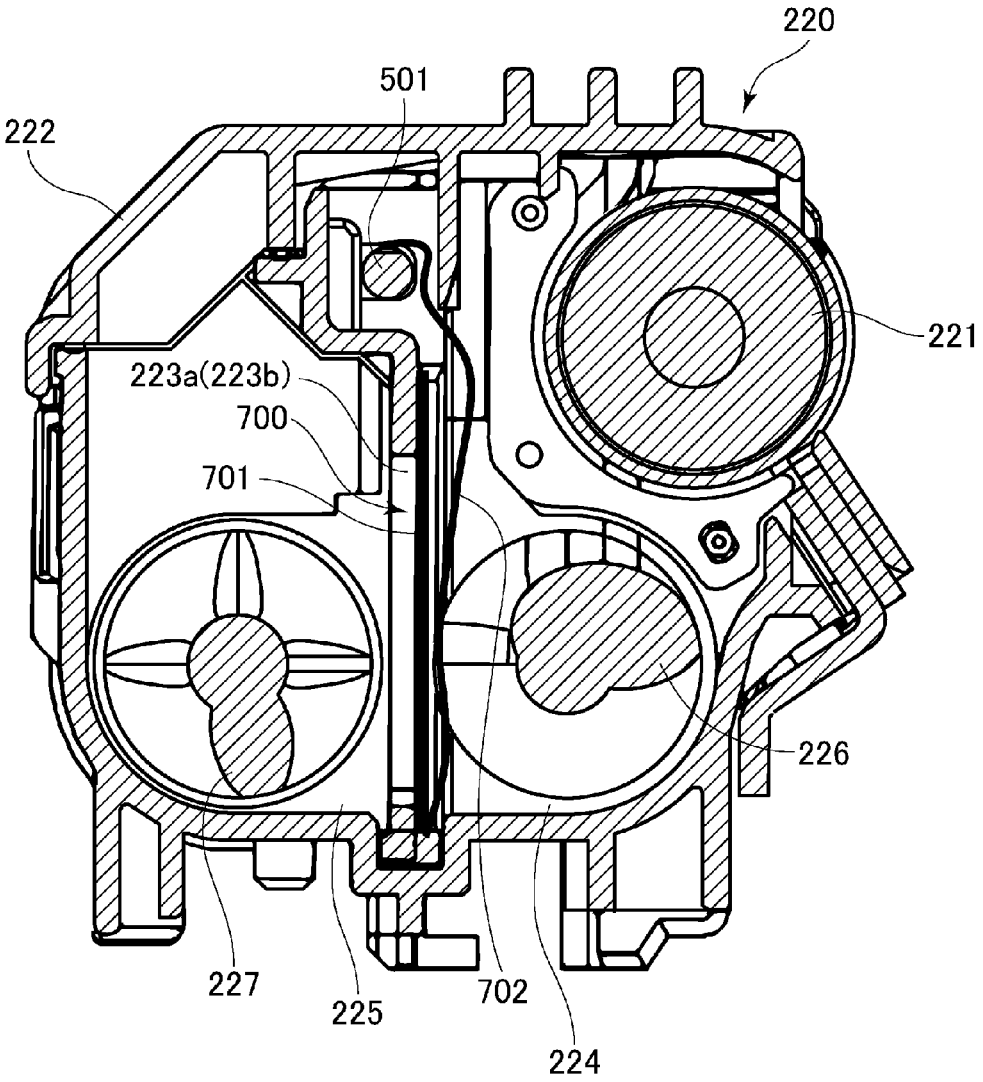

FIG. 7 is a cross-sectional view of the developing device in the first embodiment, at a plane which is perpendicular to the lengthwise direction of the device, and which coincides with one of the developer passages between the two chambers of the device.

Figure 8:
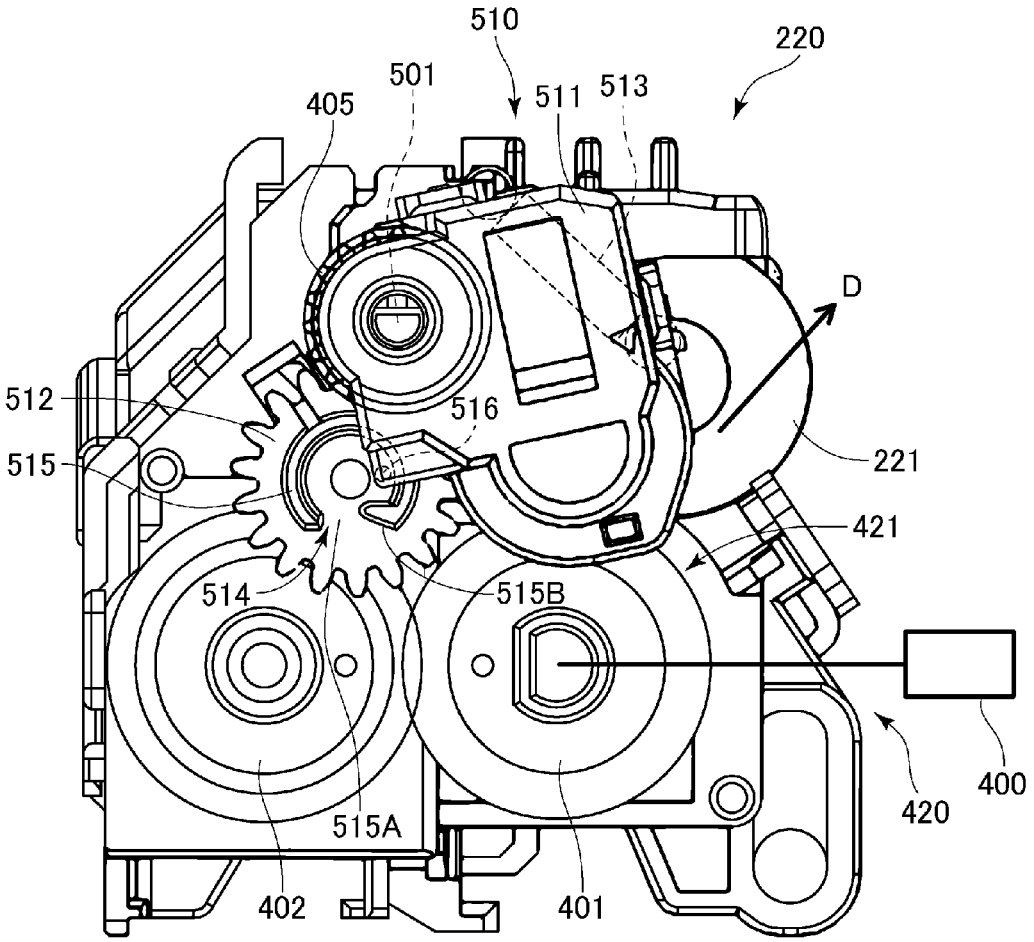

FIG. 8 is a plan view of the sealing sheet take-up mechanism of the developing device in the first embodiment, and shows the structure of the mechanism.

Figure 9:
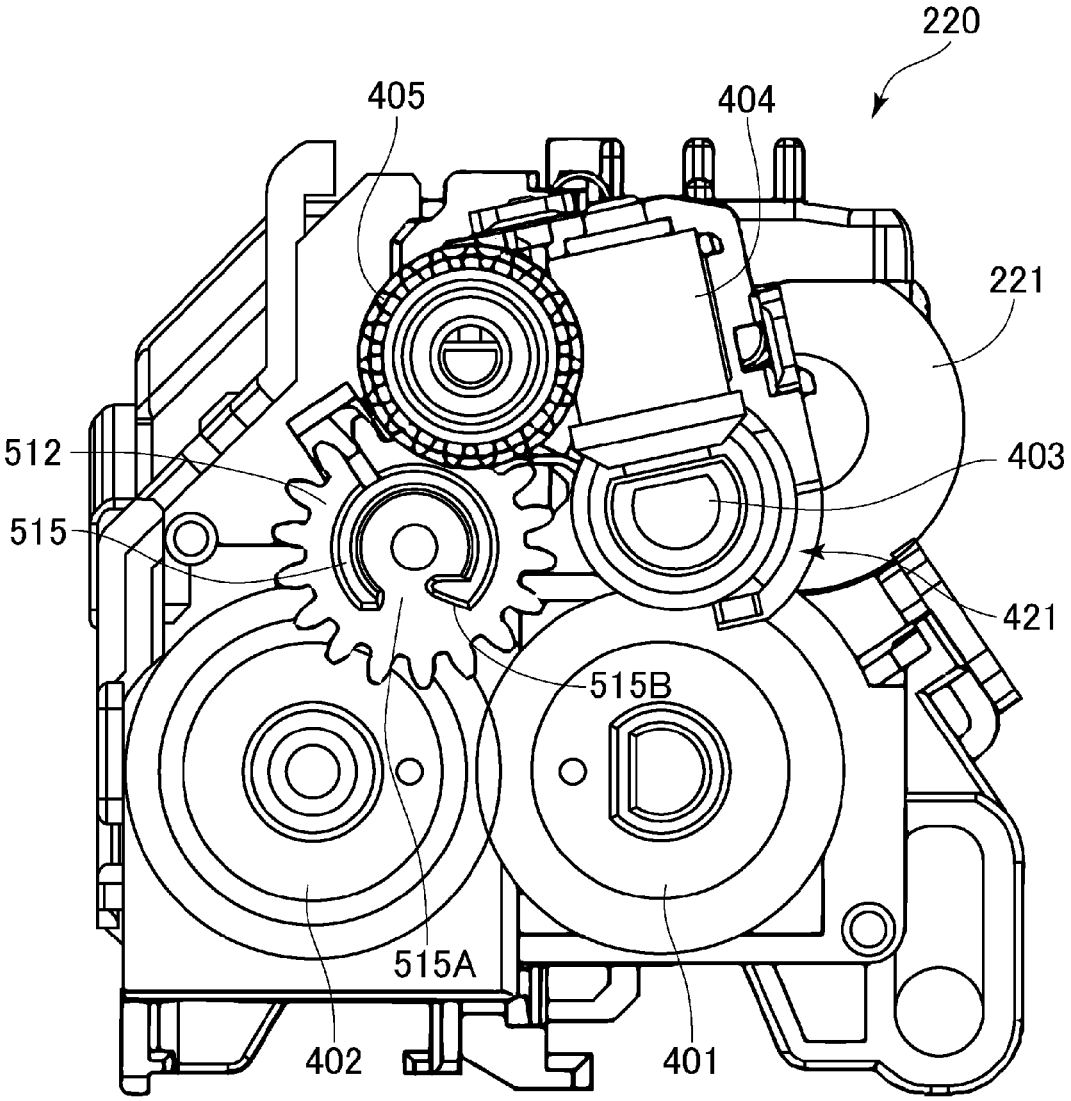

FIG. 9 is a plan view of the sealing sheet take-up mechanism (minus the holder) of the developing device in the first embodiment, and shows the structure of the mechanism.

Figure 10:
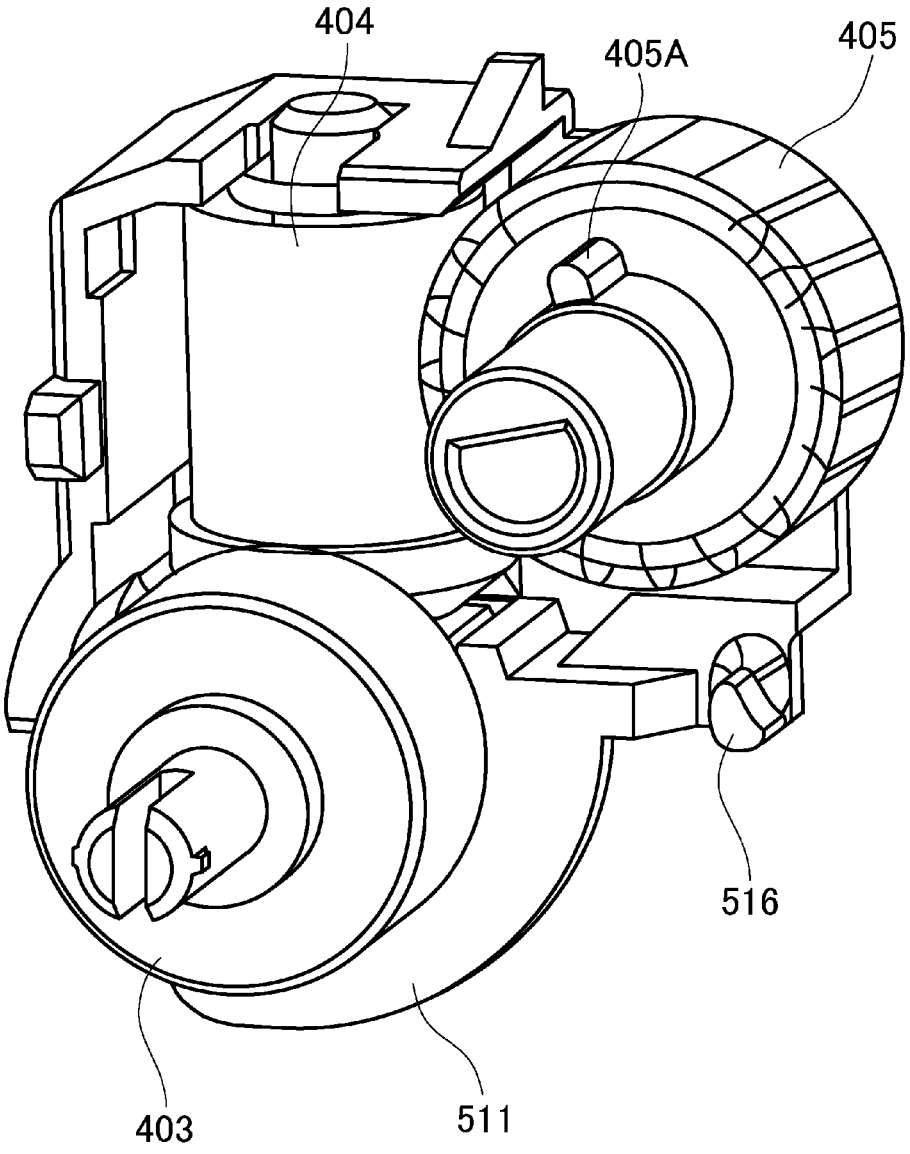

FIG. 10 is a perspective view of the gear train held by the holder, in the first embodiment.

Figure 11:
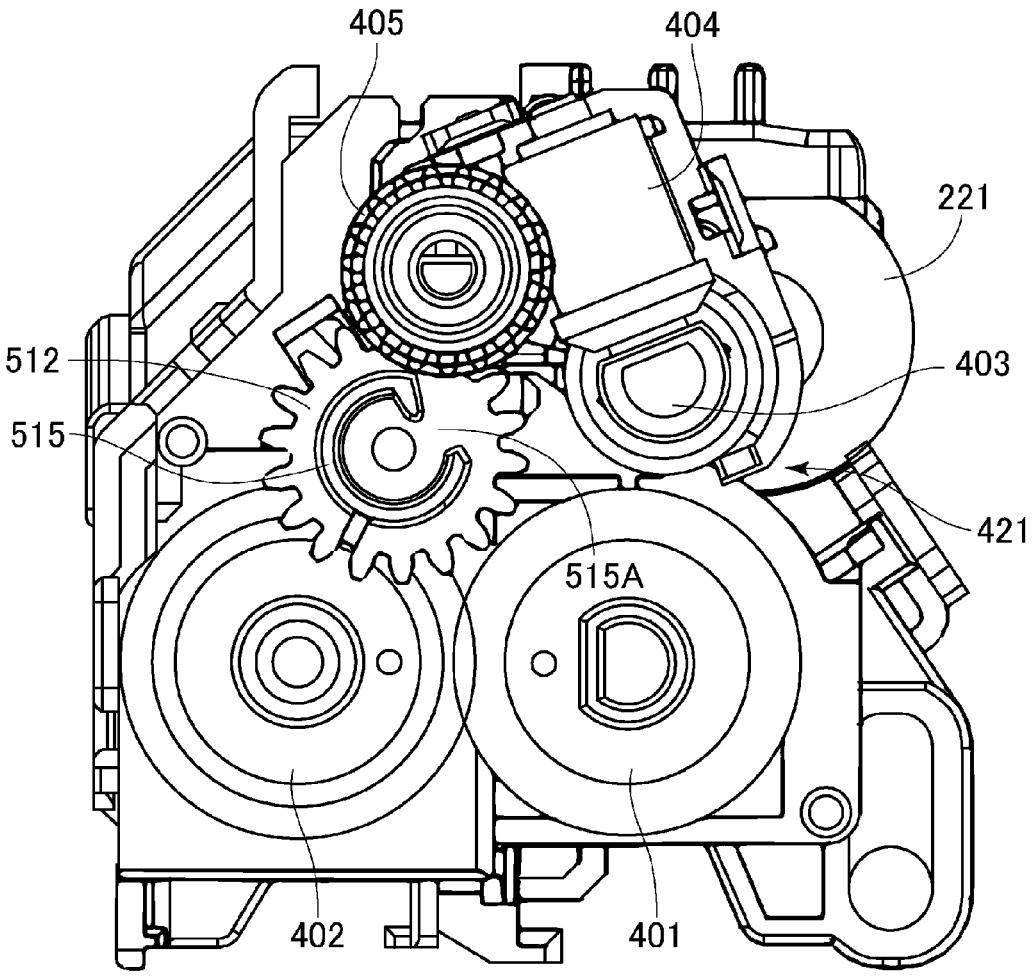

FIG. 11 is a plan view of the sealing sheet take-up mechanism of the developing device in the first embodiment after the transmission of driving force is stopped, and shows the structure of the mechanism.

Figure 12:
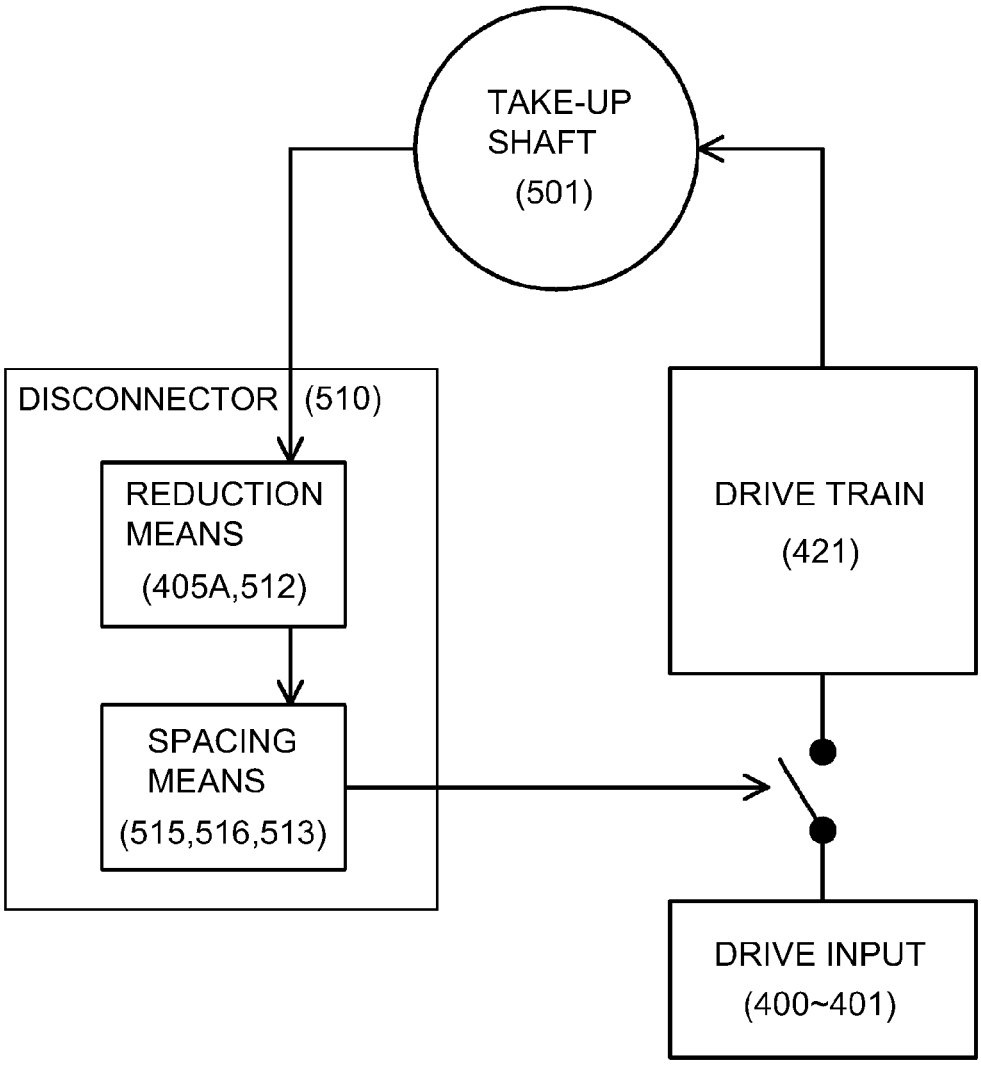

FIG. 12 is a block diagram of the system which controls the transmission (including stopping of transmission) of driving force to the sealing sheet take up mechanism.

Figure 13:
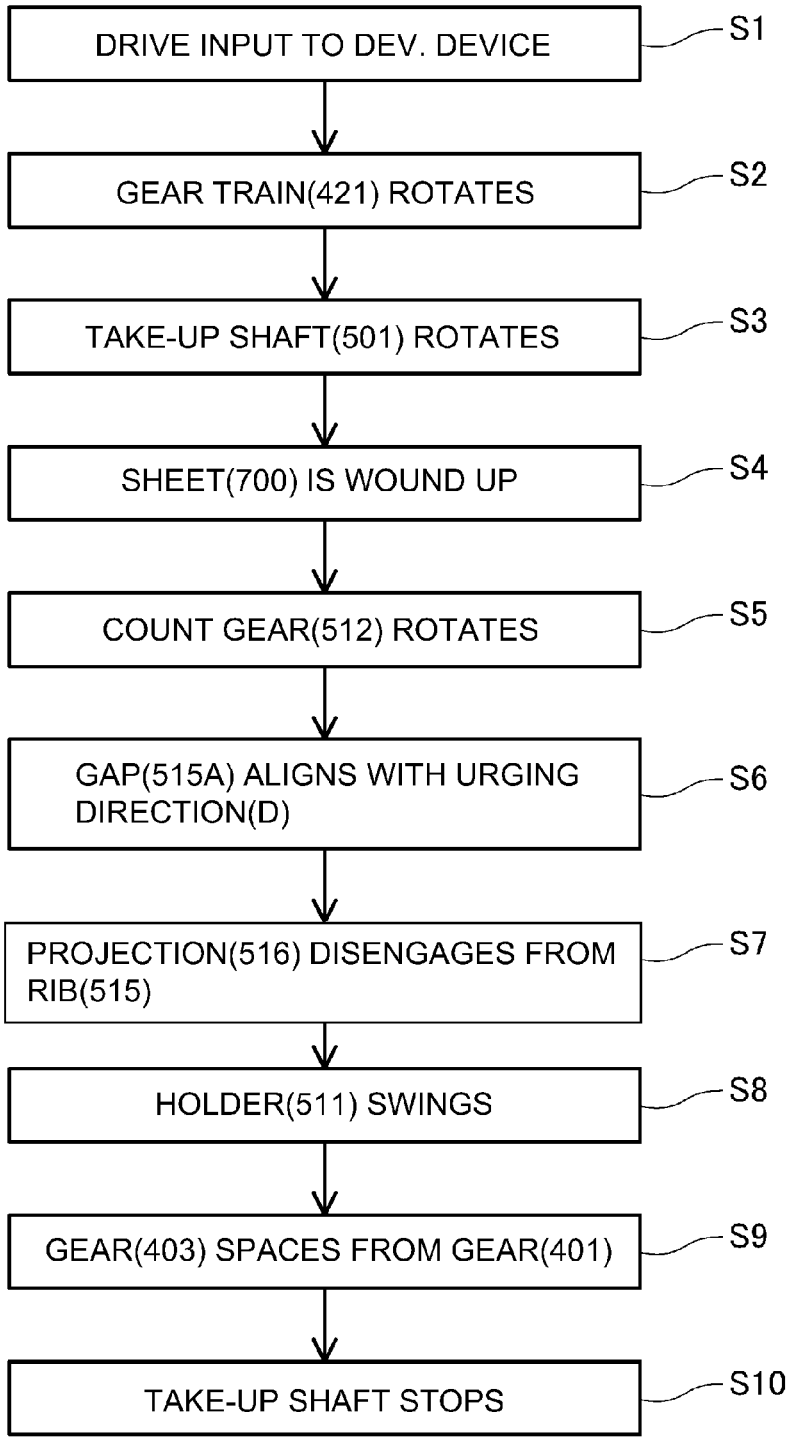

FIG. 13 is a flowchart of the sequential steps in the sealing sheet removing operation, between when driving force begins to be transmitted to the sealing sheet take-up shaft and when the transmission of the driving force to the shaft is stopped.

Figure 14:
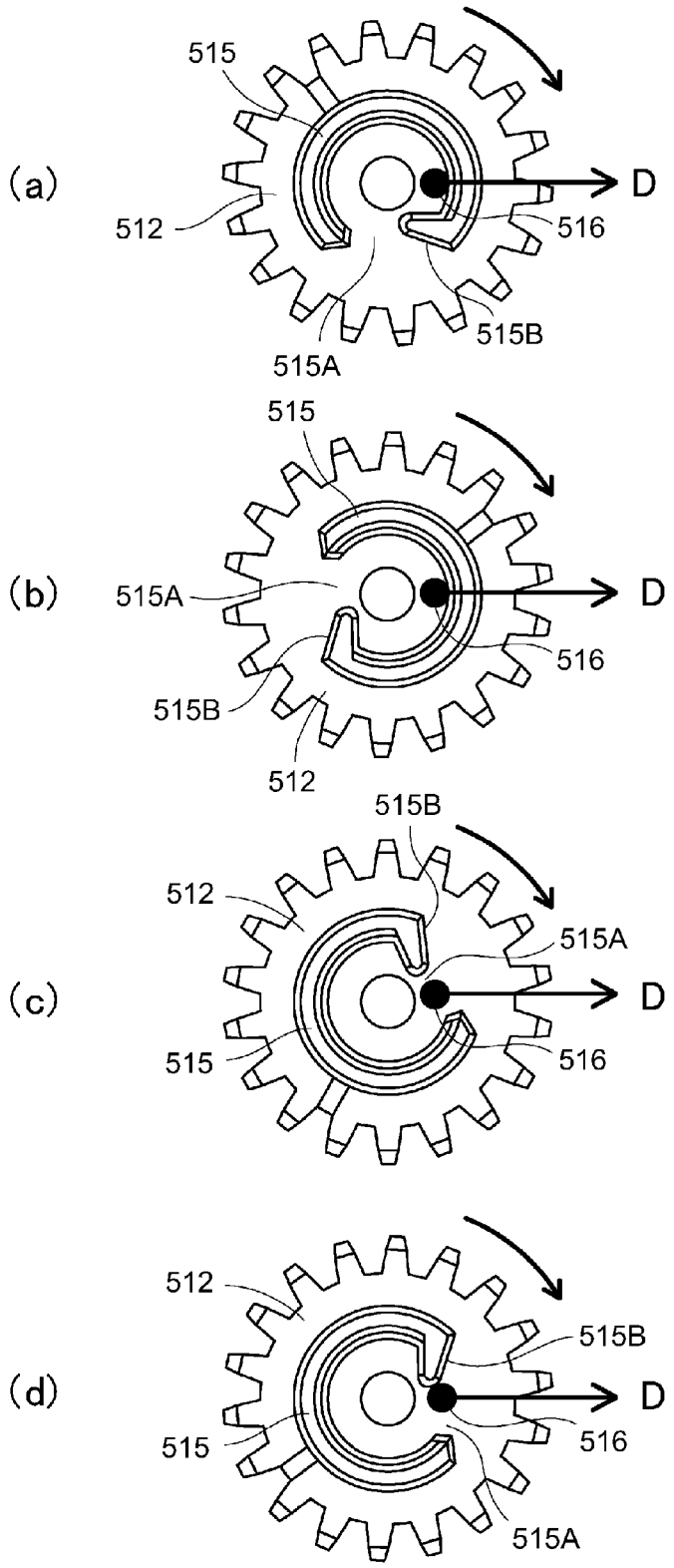

Parts (a), (b), (c) and (d) of FIG. 14 are drawings which sequentially shows the changes which are caused to the relationship between the projection and rib by the rotation of the count gear, in the first embodiment.

Figure 15:
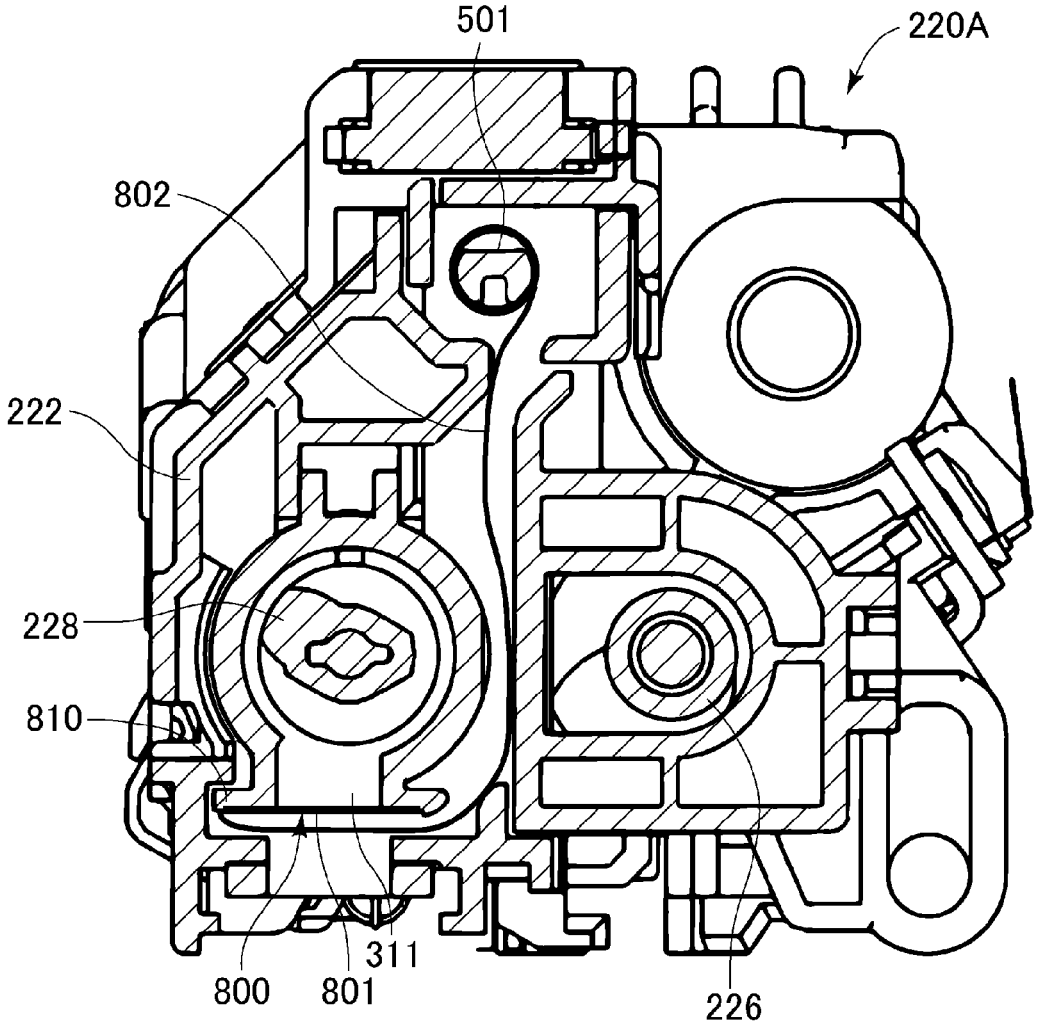

FIG. 15 is a cross-sectional view of the developing device in the second embodiment of the present invention, at a plane which is perpendicular to the lengthwise direction of the device, and which coincides with the developer outlet of the device.

DESCRIPTION OF THE EMBODIMENTS

<Embodiment 1>

Referring to FIGS. 1-14, the first embodiment of the present invention is described. To begin with, referring to FIGS. 1-3, the general structure of the image forming apparatus in this embodiment is described.

[Image Forming Apparatus]

Figure 1:
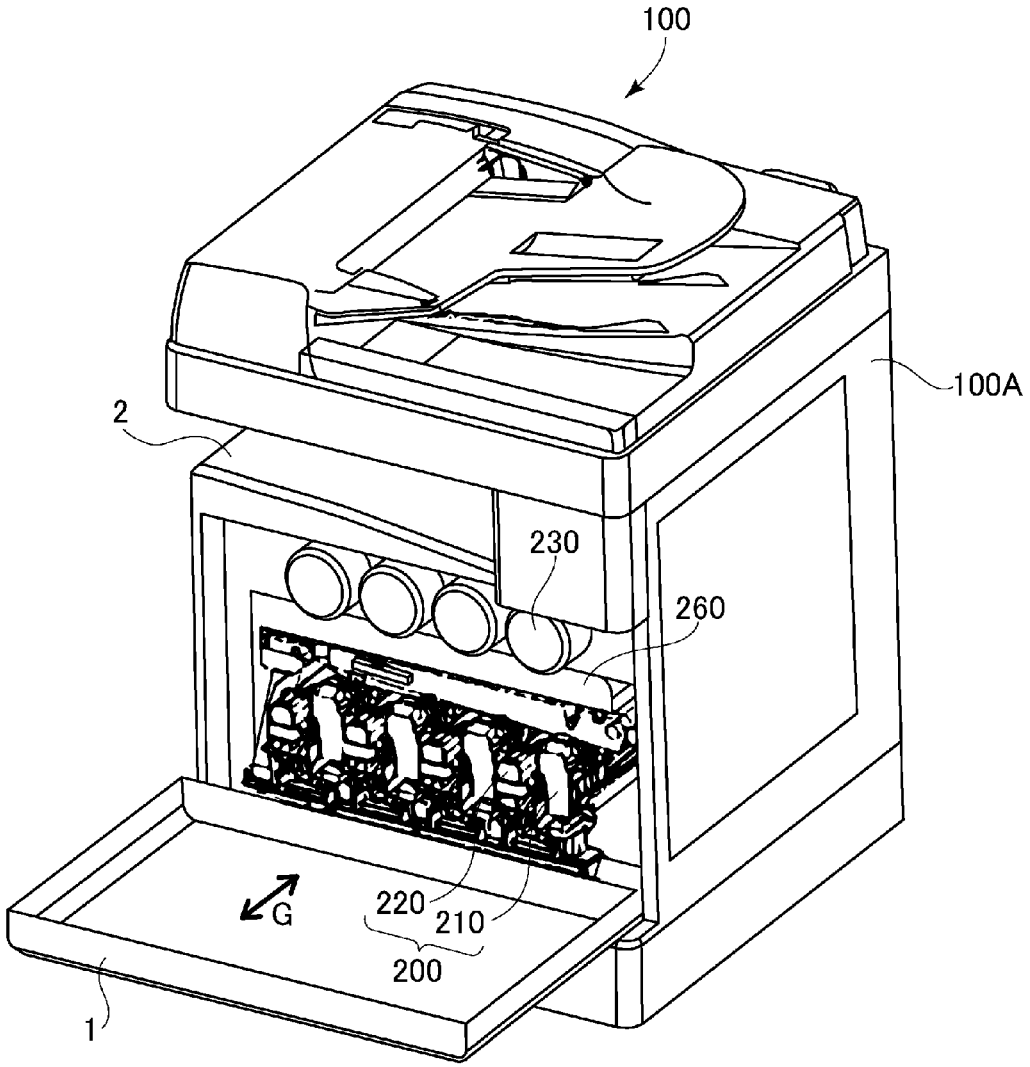
FIG. 1 is a perspective view of the image forming apparatus in the first embodiment of the present invention when the front cover of the apparatus is open.

FIG. 1 shows the entirety of the image forming apparatus 100 when the front cover 1 of the apparatus is open. It clearly shows the positioning of various units in the main assembly of the image forming apparatus 100. The image forming apparatus 100 in this embodiment employs four process units 200 (image forming sections), which form Y (yellow), M (magenta), C (cyan) and K (black) monochromatic images, one for one, and each of which is made up of a drum unit 210 and a developing device 220 (development unit). The drum unit 210 includes a photosensitive drum 211. The developing device 220 has a development sleeve 221 which is disposed in a manner to oppose the photosensitive drum 211. The four process units 200 are disposed roughly in the center portion of the main assembly 100A of the image forming apparatus 100, being roughly horizontally aligned. By the way, the four process units 200, which are different in the color of the image they form, are the same in structure. In FIG. 1, therefore, only the right end unit 200 is given referential codes.

There is disposed an intermediary transfer unit 260 above the combination of the process units 200. The intermediary transfer unit 260 is equipped with an intermediary transfer belt as an intermediary transferring member, and is disposed in a manner to oppose all of the photosensitive drums 211. The intermediary transfer belt is suspended and kept tensioned by various rollers, more specifically, a secondary transfer roller, an idler roller, a tension roller, etc. As the tension roller or idler roller is driven, the intermediary transfer belt is circularly moved by the tension roller or idler roller. There are disposed the primary transfer rollers in a manner to oppose the photosensitive drums 211, one for one, with the presence of the intermediary transfer belt between each primary transfer roller and corresponding photosensitive drum 211. As the primary transfer bias is applied to the primary transfer roller, the toner image formed on the peripheral surface of the photosensitive drum 211 is transferred (primary transfer) onto the intermediary transfer belt. The secondary transfer roller forms the secondary transfer section (nip) between itself and a belt-backing roller which is disposed in a manner to oppose the secondary transfer roller, with the placement of the intermediary transfer belt 304 between itself and the secondary transfer roller. As the secondary transfer bias is applied between the secondary transfer roller and belt-backing roller, the toner images on the intermediary transfer belt are transferred (secondary transfer) onto the recording medium conveyed to the secondary transfer section. By the way, the recording medium is a sheet of ordinary paper, OHP film, etc., for example.

Further, the image forming apparatus 100 employs four toner cartridges 230, which are different in the color of the toners which they supply. The toner cartridges 230 are disposed above the intermediary transfer unit 260. In the rear section (back section) of the image forming apparatus main assembly 100A, toner supply units are disposed, each of which is supplied with toner by the corresponding toner cartridge 230 and delivers the toner to the corresponding developing device 220. In the bottom front section of the image forming apparatus main assembly 100A, a unit 232 (FIG. 5) which catches (recovers) the developer as the developer is discharged from the developing device 220, as will be described later, is disposed. By the way, the front side of the image forming apparatus main assembly 100A, where the front cover 1 is present, is the side of the image forming apparatus 100, from which a user operates the image forming apparatus 100, and where the control panel, and the like, are disposed. On the other hand, the rear side of the image forming apparatus main assembly 100A is the opposite side of the main assembly 100A from the front side. It is the side where the circuit boards for various controls, electrical power sources, motors, etc., are disposed.

Further, the image forming apparatus 100 is equipped with a laser unit 240 (FIG. 3) as an exposing device, cassettes, a fixing device, a delivery tray 2, etc. The laser unit 240 is disposed below the combination of the process units 200. The fixing device is disposed in the recording medium conveyance passage. The delivery tray 2 is one of the top portions of the apparatus main assembly 100A. Further, the drum unit 210, developing device 220, and intermediary transfer unit 260 are removably installable in the apparatus main assembly 100A. Thus, the image forming apparatus 100 is equipped with the above-described front cover 1 as a door for allowing a user to access the interior of the image forming apparatus 100. That is, as the front cover 1 is opened from the front side of the apparatus main assembly 100A, any unit can be exposed so that it can be extracted from, or reinserted into, the apparatus main assembly 100A, or can be replaced with a new unit, in the direction indicated by a two-headed arrow mark G in FIG. 1.

[Process Unit]

Figure 2:
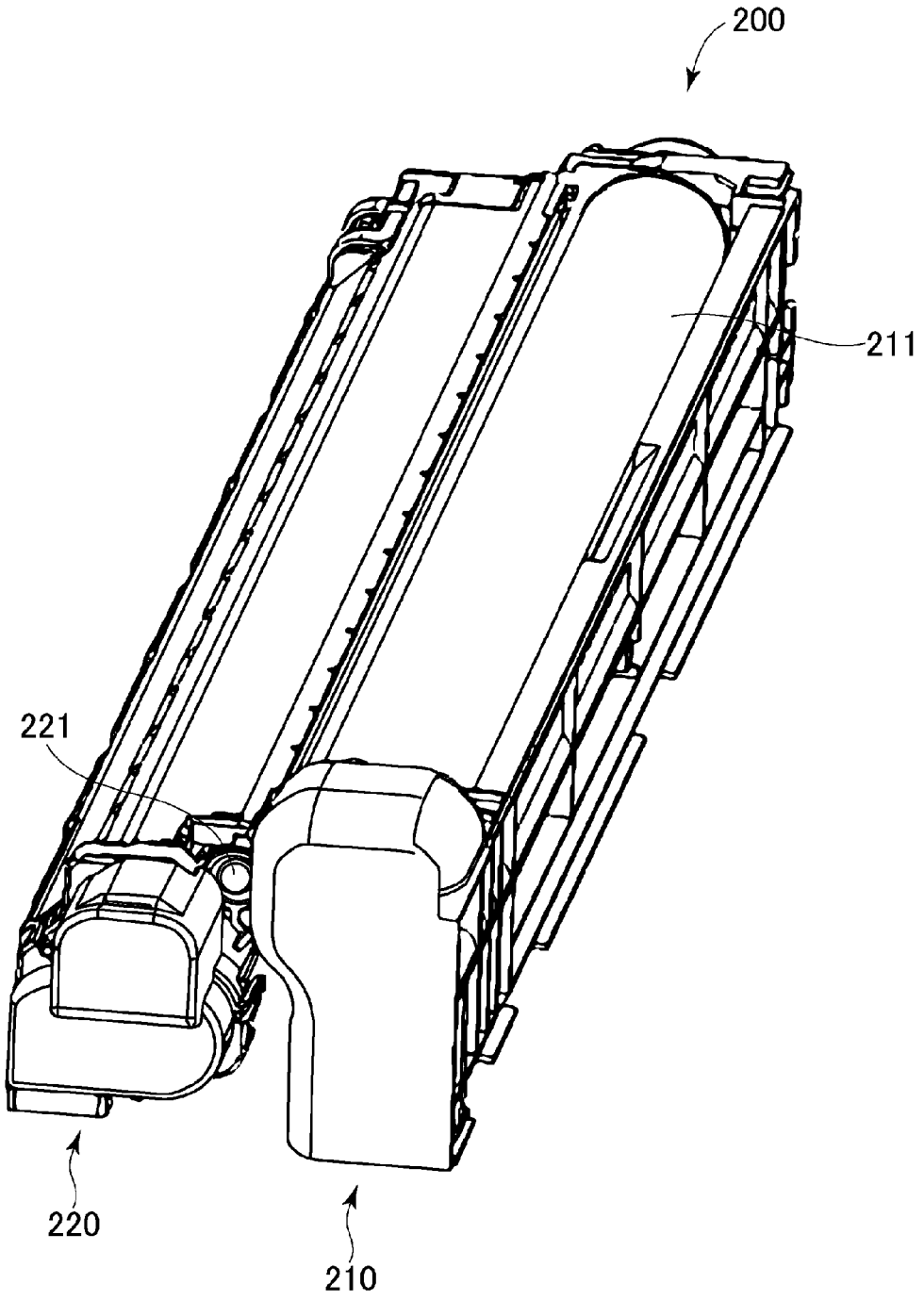
FIG. 2 is a perspective view of one of the process units in the first embodiment.
Figure 3:
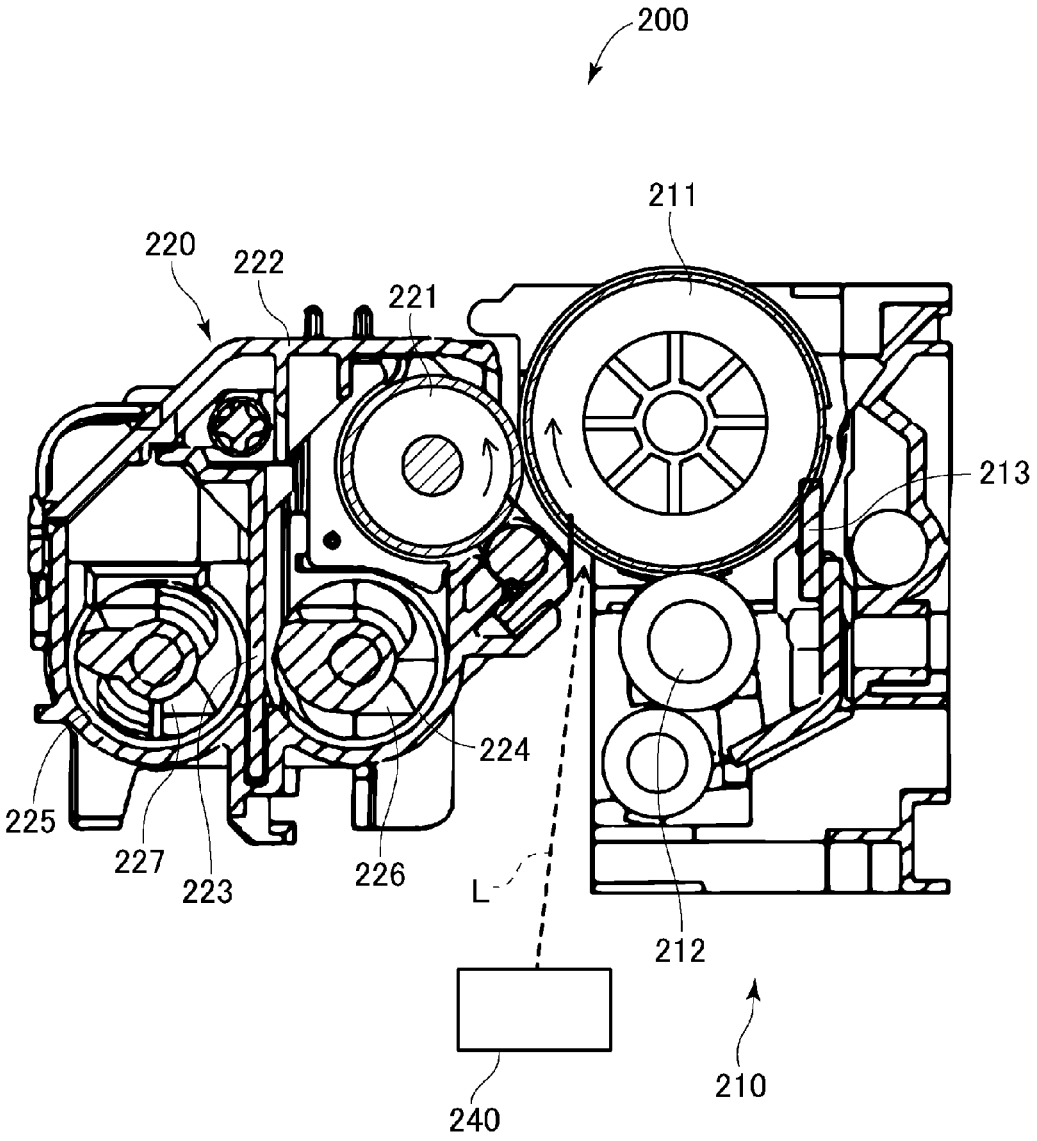
FIG. 3 is a cross-sectional view of the process unit in the first embodiment.

Next, referring to FIGS. 2 and 3, the above-described process units 200 are described about their structure. Each development unit 210 has the photosensitive drum 211 as an image bearing member. It has also a charge roller 212 as a charging device, a cleaning device 213, etc., which are disposed in the adjacencies of the peripheral surface of the photosensitive drum 211. As for the developing device 220, it has a developing means container 222 which holds developer made up of toner and carrier. It has also a cylindrical development sleeve 221 as a developer bearing member, which is rotatably supported in the developing means container 222 so that it opposes the photosensitive drum 211 through the opening of the developing means container 222.

Next, the process, which is carried out by the image forming apparatus 100 equipped with the process units 200 structured as described above, to form a full-color image, based on the four primary colors, is described. As an image forming operation is started, the photosensitive drum 211 begins to be rotated in the direction indicated by an arrow mark in FIG. 3, and the peripheral surface of the rotating photosensitive drum 211 is uniformly charged by the charge roller 212. Then, the peripheral surface of the photosensitive drum 211 is exposed to the beam L of laser light emitted from the laser unit 240 while being modulated with the image formation signals. Thus, an electrostatic latent image, which is in accordance with the image formation signals, is formed on the peripheral surface of the photosensitive drum 211. The electrostatic latent image on the photosensitive drum 211 is developed into a visible image by the toner stored in the developing device 220. In this embodiment, a reversal developing method is used, which adheres toner to the points of the peripheral surface of the photosensitive drum 211, which were exposed to the aforementioned beam of laser light. The toner image formed on the peripheral surface of the photosensitive drum 211 is transferred (primary transfer) onto the intermediary transfer belt. The toner (transfer residual toner) which is remaining on the peripheral surface of the photosensitive drum 211 after the primary transfer is removed by the cleaning device 213.

An operation such as the above-described one is sequentially carried out in the process units 200, which use yellow, magenta, cyan, and black toners, one for one. Consequently, four monochromatic toner images which are different in color are layered on the intermediary transfer belt. Meanwhile, one of the sheets of recording medium stored in a tray (unshown) is conveyed to the secondary transfer section in synchronism of the formation of the toner images. Then, in the secondary transfer section, the four toner images, different in color, are transferred together (secondary transfer) onto the sheet of recording medium.

Next, the sheet of recording medium is conveyed to the fixing device (unshown), in which the sheet is heated and pressed. Thus, the toner on the sheet melts and mixes, and becomes fixed to the sheet, yielding a fixed full-color image. Thereafter, the sheet is discharged into the delivery tray 2, concluding thereby the image formation process. By the way, the image forming apparatus 100 can be operated to use only a desired one among the above-described four image formation sections, to form a monochromatic image of the desired color, or can be operated to use two or more of the four image formation sections, to form a multicolor image.

[Developing Device]

Figure 4:
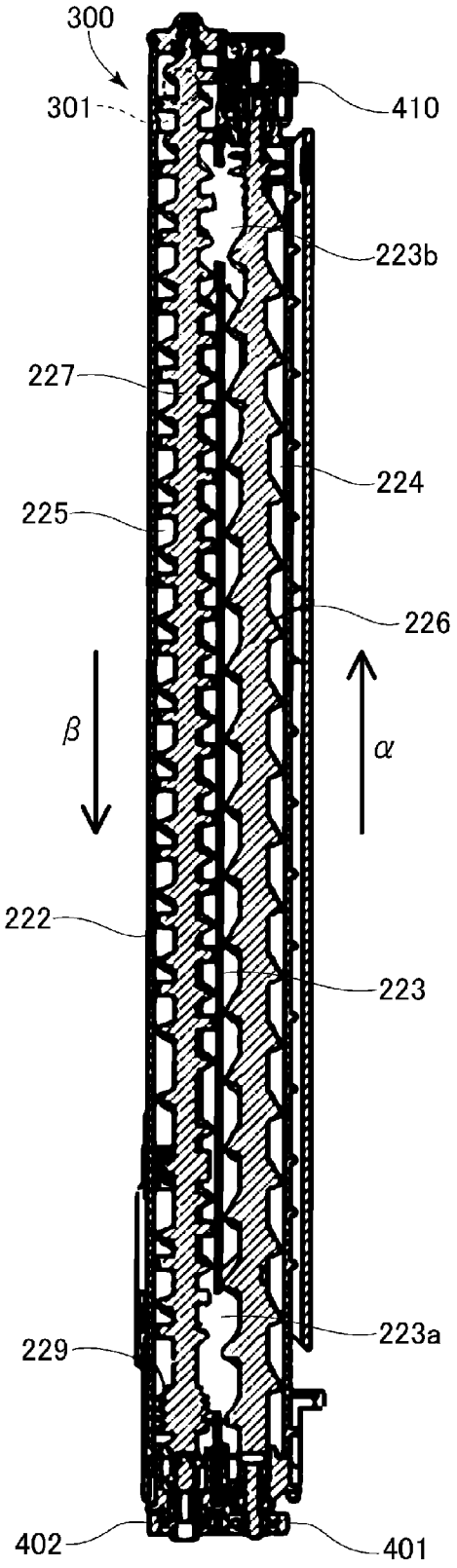
FIG. 4 is a vertical cross-sectional view of the developing device in the first embodiment.

Next, referring to FIGS. 3 and 4, the developing device 220 in this embodiment is described in detail about intermediary transfer unit 260 structure. The developing device 220 is provided with the development sleeve 221, and developing means container 222 which stores two-component developer made up primarily of toner and carrier. The developing device 220 in this embodiment is of the so-called trickle replenishment type. That is, not only can it be replenished with a fresh supply of toner, but also, can discharge the excessive amount of developer in the developing container 222. The development sleeve 221 is disposed in the immediate adjacencies of the peripheral surface of the photosensitive drum 211, with the presence of a preset amount of distance between itself and photosensitive drum 221. There is disposed an unshown magnet within the hollow of the development sleeve 221, so that the developer is borne on the peripheral surface of the development sleeve 221 by the magnetic force of the magnet.

At this time, the developer is described. The developing method used in this embodiment is a two-component developing method, which uses a mixture of nonmagnetic toner, which becomes negatively charged, and magnetic carrier. The nonmagnetic toner is made by mixing coloring agents, waxes, etc., into such resin as polyester, styrene-acrylic, or the like. It is made by pulverization or polymerization. It is in the form of powder. The magnetic carrier is made up of a magnetic core, and a surface layer coated on the surface of the core. The magnetic core is a ferrite particle, or a resin particle which contains a magnetic substance. The surface layer is made of resinous substance.

The developing means container 222 has a development chamber 224 (second chamber) and a stirring chamber 225 (first chamber), which are separated by a partition wall 223. There is developer in both the development chamber 224 and stirring chamber 225. In other words, the partition wall 223 is between the development chamber 224 and stirring chamber 225. The development chamber 224 and stirring chamber 225 are disposed so that they are at roughly the same level, and also, so that their lengthwise directions are parallel to the direction (lengthwise direction) of the rotational axis of the development sleeve 221. The lengthwise ends of the partition wall 223 are not in contact with the inward surface of the corresponding lengthwise end of the developing means container 222. Thus, there are passages 223*a* and 223*b*, which allow developer to move between the development chamber 224 and stirring chamber 225, at the lengthwise ends of the partition wall 223, one for one. In other words, the developing device 220 is provided with passages through which the developer is circularly moved in the developing device 220 alternately through the development chamber 224 and stirring chamber 225.

The development chamber 224 and stirring chamber 225 have the first and second screws 226 and 227, respectively, which function as members for recirculating the developer in the developing means container 222, by conveying the developer alternately through the development chamber 22 and stirring chamber. That is, in the development chamber 224, the first screw 226 which functions as a conveying member which supplies the development sleeve 221 with the developer in the development chamber 224 while conveying the developer is disposed in parallel to the rotational axis of the development sleeve 221. Thus, as the developer in the development chamber 224 is conveyed in the direction indicated by an arrow mark α in FIG. 4 by the rotation of the first screw 226. In the stirring chamber 225, the second screw 227 which conveys, while stirring, the developer supplied by the toner replenishment unit, as will be described above, is disposed in parallel to the rotational axis of the development sleeve 221. Thus, the developer in the stirring chamber 225 is conveyed by the rotation of the second screw 227 in the direction indicated by an arrow mark β in FIG. 7, which is the opposite direction from the developer conveyance direction of the first screw 226. Each of the first and second screws 226 and 227 is made up of a rotational shaft, and a spiral blade spirally fitted around the rotational shaft. Thus, while the developer is conveyed between the development chamber 224 and stirring chamber 225 while being stirred, the toner is negatively charged, whereas the carrier is positively charged.

The development sleeve 221 rotates in the direction indicated by an arrow mark in FIG. 3. As it rotates, it bears and conveys the developer in the development chamber 224 toward a blade as a developer regulating member. Then, as the development sleeve 221 rotates further, the developer layer on the development sleeve 221 is regulated in thickness, being thereby in the amount per unit area of the peripheral surface of the development sleeve 221. Consequently, a development layer which has a preset thickness is formed on the peripheral surface of the development sleeve 221. This developer layer is moved by the further rotation of the development sleeve 221 into the area of contact between the development sleeve 221 and photosensitive drum 211, and develops the electrostatic latent image on the peripheral surface of the photosensitive drum 211. After the development layer is used for the development, it is peeled away from the development sleeve 221, and is recovered into the development chamber 224.

[Developer Replenishment]

Referring to FIG. 4, on the upstream side of the developer passage 223*b* of the stirring chamber 225 in terms of the developer conveyance direction of the second screw 227, a replenishment section 300 is provided, which replenishes the development chamber 224 with a fresh supply of developer which contains toner and carrier. The replenishment section 300 has a replenishment opening 301 which is positioned so that as the developing device 220 is installed into the apparatus main assembly 100A, the replenishment opening is positioned in the rear of the apparatus main assembly 100A, and above the second screw 227. The replenishment section 300 is replenished with a fresh supply of developer from an unshown toner replenishment unit, as a replenishing means, with which the apparatus main assembly 100A is provided. That is, referring to FIG. 1, a toner cartridge 230 which contains a fresh supply of developer is disposed above the developing device 220. Thus, developer is supplied to the toner replenishment unit from the toner cartridge 230. The toner replenishment unit is provided with a screw as a developer conveying member, one end of which is in the adjacencies of the replenishment opening 301.

As the developer (toner) in the developing device 220 is consumed for image formation, developer (toner) is supplied to the stirring chamber 225, by an amount which is roughly equal to the amount of the consumption, from the toner replenishment unit, through the replenishment opening 301 by the combination of the rotation of the replenishment screw and weight of the developer. As developer is delivered to the stirring chamber 225, it is conveyed in the stirring chamber 225 by the rotation of the second screw 227. The amount by which the developer is delivered is roughly determined by the number of revolutions of the replenishment screw 227 as a developer conveying member. This number of times the replenishment screw is rotated is set by a toner replenishment amount controlling means. As the method for controlling the amount by which toner is delivered, a method which optically or magnetically detects the toner density of the two-component developer, a method which develops a referential latent image on the peripheral surface of the photosensitive drum 211 into a toner image (test patch), and detects the density of the tone image, etc., have been known. Thus, any of these methods may be selected. For example, an inductance sensor which magnetically detects the toner density of the developer in the developing means container 222, and both the results of the detection of the toner density by the induction sensor, and the results of the detection of the density of the toner image (test patch), may be used to replenish the developing device 220 with developer.

[Developer Discharge]

As a fresh supply of developer is delivered into the stirring chamber 225 through the replenishment section 300, the developer is conveyed, while being stirred, by the rotation of the second screw 227. Thus, the toner and carrier in the developer are made to rub against each other. Consequently, they become charged; they are given triboelectric charge. Then, they are conveyed further to the development chamber 224, in which they are used for development. As the development means container 222 is replenished with the fresh supply of toner as described above, the developing means container 222 increases in the amount of the developer therein. In this embodiment, therefore, the developing means container 222 is provided with a developer discharging section 310, which discharges a part (excessive amount of developer) of the developer in the developing means container 222. That is, the toner in the developer is used for development. However, the carrier in the developer is not used for development, and therefore, remains in the developing means container 222. As the carrier remains in the developing means container 222, it gradually deteriorates in charging performance. In this embodiment, therefore, a part of the developer in the developing means container 222 is discharged by the developer discharging section 310 to keep the amount of the developer in the developing means container 222 within a preset range, and also, to discharge the deteriorated carrier.

Referring to FIGS. 5(*a*) and 6, the discharging section 310 is positioned on the downstream side of the developer passage 223*a* of the stirring chamber 225 in terms of the developer conveyance direction of the second screw 227. The discharging section 310 has a developer outlet 311 which is positioned so that after the proper installation of the developing device 220 into the apparatus main assembly 100A, the developer outlet 311 is in the front end portion of the apparatus main assembly 100A, and below the second screw 227. That is, in this embodiment, the developer outlet 311 opens at the bottom of the developing means container 222 in terms of the gravity direction. Referring to FIG. 6, a discharged screw 228, which is integral with the second screw 227, is in the discharging section 310. As the developer is conveyed into the discharging section 310, the discharge screw 228 discharges the developer out of the discharging section 310 through the developer outlet 311.

Further, there is disposed in the stirring chamber 225, a return screw 229, which is integral with the second screw 227, and is on the upstream side of the discharging section 310. As the developer in the stirring chamber 225 is conveyed to the return screw 229, the return screw 229 pushes the developer back, sending (delivering) thereby the developer into the development chamber 224 through the developer passage 223*a*. By the way, in FIG. 6, the developer passage 223*a* is remaining sealed with a sealing sheet 700, which will be described later. However, when the developing device 220 is in use, this sealing sheet 700 will have been removed, and therefore, the developer passages 223*a* and 223*b* will be open. As the developer is conveyed to the return screw 229 by the second screw 227, a part of the developer passes by the return screw 229, reaches the discharging section 310, and is discharged by the discharge screw 228 through the developer outlet 311. That is, as the developing means container 222 becomes excessive in the amount of the developer therein, the downstream end of the second screw 227 is subjected to an excessive amount of developer pressure, which exceeds the amount of developer pressure which the return screw 229 generates. Thus, a part of the developer advances downstream beyond the return screw 229, and then, is discharged from the developing means container 222 through the developer outlet 311. As the excess amount of developer is discharged, the downstream end of the second screw 227 reduces in developer pressure, and therefore, the developer discharge stops. Through the above-described process, the developing means container 222 stabilizes in the amount of the developer therein, within a preset range.

As the developing device 220 is installed into the apparatus main assembly 100A, the discharging section 310 becomes connected to the recovered toner conveyance unit 232, as a recovery means, with which the apparatus main assembly 100A is provided. Thus, as the excessive amount of developer is discharged through the developer outlet 311 as described above, it is recovered into the recovered toner conveyance unit 232, and conveyed to an unshown recovery developer container.

Further, referring to FIG. 5(*a*), the discharging section 310 has a shutter 312 which opens or shuts the developer outlet 311. The shutter 312 is movable between a position in which it covers the developer outlet 311, and a position in which it keeps the developer outlet 311 open. Next, referring to FIG. 5(*b*), the shutter is moved by a shutter moving mechanism as a shutter moving means.

The shutter moving mechanism 320 has a spring 321 which keeps the shutter outlet shutter 312 closed by its resiliency, and an engaging section which is a part of the shutter 312. As the developing device 220 is inserted into the apparatus main assembly 100A, the engaging section 322 engages with the engaging section 323 with which the recovery toner conveyance unit 232 is provided, causing thereby the shutter 312 to move to its open position against the resiliency of the spring 321. On the other hand, as the developing device 220 is moved outward of the apparatus main assembly 100A to be uninstalled, the shutter 312 is moved into its closed position by the resiliency of the spring 321.

In this embodiment, the developing device 220 is removably installable in the apparatus main assembly 100A as described above. Therefore, the image forming apparatus 100 is structured so that as the developing device 220 is moved outward of the apparatus main assembly 100A to be removed, the shutter 312 shuts the developer outlet 311 to keep the developer in the developing means container 222 sealed in the developing means container 222.

[Structure for Keeping Initial Supply of Developer Sealed in Stirring Chamber]

Next, referring to FIGS. 6 and 7, how the initial supply of developer in the developing device 220 is kept sealed in the stirring chamber 225 is described. It is possible that the image forming apparatus 100 will be dropped or subjected to vibrations while it is transported. Thus, in a case where the image forming apparatus 100 is shipped out of a factory, warehouse, etc., while the initial supply of developer is in the developing device 220, it is possible that the developer in the developing device 220 will scatter through the gaps in the adjacencies of the development sleeve 221, and contaminate the interior of the image forming apparatus 100. Therefore, when the developing device 220 is brand-new, the initial supply of developer is kept sealed in the stirring chamber 225.

That is, when the developing device 220 is brand-new, the developer passages 223*a* and 223*b* which are between the development chamber 224 and stirring chamber 225 remain sealed with the sealing sheet 700. The sealing sheet 700 is made of thin laminated film, the substrative layer of which is such film that is made of polyester, Nylon, polyethylene or the like substance. Its thickness is in a range of 100-200 μm. The sealing sheet 700 is fixed to the edge portions of the developer passages 223*a* and 223*b* with the use of an irreversible means such as adhesive or welding to keep the developer passages 223*a* and 223*b* sealed. Thus, when the developing device 220 is brand-new, only the stirring chamber 225 contains the developer. That is, the developer is not in the development chamber 224; no carrier or toner is present in the development chamber 224. That is, the developer passage 223 and 223*b* are sealed with the sealing sheet 700 after the developer is put in the stirring chamber 225 so that the developer remains sealed in the stirring chamber 225 until the developing device 220 begins to be driven for initialization. By the way, the "initialization driving of the apparatus" means that the developing device 220 is driven for the first time after the image forming apparatus 100 which contains a brand-new developing device 220 is set up, or a brand-new developing device 220 is installed into the apparatus main assembly 100A.

The sealing sheet 700 is in a long and narrow rectangular shape. It can be removed from the developer passages 223*a* and 223*b* by being taken up (wound up) by a take-up shaft 501 as a sealing sheet removing means (means for taking up sealing sheet, driven member). More concretely, the sealing sheet 700 has a cover section 701 which actually keeps the developer passages 223*a* and 223*b* sealed, and a connective section 702 which is folded back at one end of the cover section 701 (bottom end in FIG. 7) and is extended to the take-up shaft 501. The take-up shaft 501 takes up the connective section 702 to peal the cover section 701, starting from the abovementioned end. That is, the cover section 701 is fixed to the edges of the developer passages 223*a* and 223*b* by welding, from one end to the other (top end in FIG. 7), keeping thereby the developer passages 223*a* and 223*b* sealed. One end of the connective section 702 is in connection to one end of the cover section 701, and the other end of the connective section 702 is attached to the take-up shaft 501 with the use of adhesive or the like. Therefore, as the take-up shaft 501 begins to be rotated, the connective section 702 begins to be taken up, whereby the cover section 701 begins to be peeled way, starting from one end. Consequently, the cover section 701 is removed from the developer passages 223*a* and 223*b*.

[Structure for Taking Up Sealing Sheet]

Referring to FIGS. 8 and 9, the take-up shaft 501 is rotatably supported by the developing means container 222. To one end of the take-up shaft 501, a driver gear 405 is fixed. The driver gear 405 is driven by a motor 400, as a driving force source, through a gear train 421 shown in FIG. 9. The motor 400 is disposed in the rear section of the apparatus main assembly 100A. As the developing device 220 is installed into the apparatus main assembly 100A, the motor 400 becomes connected to the driving section 410 (FIG. 4) which drives the first screw 226 which is in the rear section of the developing device 220. Not only is the driving section 410 in connection to the first screw 226, but also, a rotational member, with which the apparatus main assembly 100A is provided, and which is rotated by the motor 400, with the presence of a coupling between the driving section 410 and rotational member, so that the rotation of the motor 400 is transmitted to the first screw 226.

Referring to FIGS. 8 and 9, the front end of the first screw 226 of the developing device 220 is in connection to a driver gear 401. Further, referring to FIG. 9, there are disposed a gear 403 and a worm gear 404 between the driver gear 401 and driver gear 405. That is, the developing device 220 is structured so that the rotation of the driver gear 401 is transmitted to the driver gear 405 through the gear train 421 (train of rotational members) made up of multiple rotational members, more specifically, the gear 403, worm gear 404, etc. Therefore, as the first screw 226 is rotationally driven by the motor 400, the driver gear 405 rotates the take-up shaft 501, by rotating the driver gear 401, gear 403, and worm gear 404. That is, the take-up shaft 501 is driven by the driving section 410, as driving means, which drives the first screw 226 as a conveying member. That is, the driving section 410, driver gear 405, and the components between the driving section 410 and driver gear 405, make up the driving force transmission mechanism 410 which transmits to the take-up shaft 501, the driving force inputted to the developing device 220.

By the way, the gear 402 is in connection to the second screw 227 in the stirring chamber 225. It is rotated by being in mesh with the driver gear 401, and rotationally drives the second screw 227. Therefore, the first screw 226 and second screw 227 are driven by the motor 400 in synchronism with each other. Incidentally, the developing device 220 may be structured so that the development sleeve 221 driven by the motor 400 in synchronism with the first screw 226, or the development sleeve 221 alone is rotationally driven by a motor other than the motor 400.

As described above, as the take-up shaft 501 is rotated, the sealing sheet 700 is taken up by the take-up shaft 501. Therefore, as the motor 400 begins to be driven to drive the developing device 220 for initialization, the take-up shaft 501 begins to rotate, beginning thereby to take up the sealing sheet 700. Then, as the take-up shaft 501 continues to rotate, the cover portion 701 of the sealing sheet 700 is peeled away from the edges of the developer passages 223*a* and 223*b*. Consequently, the sealing sheet 700 is removed from the developer passages 223*a* and 223*b*. In other words, the development chamber 224 and stirring chamber 225 become connected to each other through the developer passages 223*a* and 223*b*. After the sealing sheet 700 is removed from the developer passages 223*a* and 223*b*, it is completely taken up by the take-up shaft 501 by the further rotation of the take-up shaft 501. That is, as driving force is inputted into the developing device 220 for initialization, the sealing sheet 700 is taken up. Then, the initial supply of developer which remained sealed in the stirring chamber 225 is conveyed into the development chamber 224 through the opened developer passages 223*a* and 223*b*, making it possible for the development sleeve to be supplied with the developer.

At this time, the gear train 421 made up of the above-described driver gear 401, gear 403, worm gear 404, and driver gear 405 is described further. From the standpoint of preventing the sealing sheet 700 from being torn and/or being unsatisfactorily taken up, it is desired that the take-up shaft 501 is gently rotated. Thus, it is desired that the gear train 421 is high in speed reduction ratio. In this embodiment, therefore, the gear train 421 is provided with the worm gear 404 to increase the gear train 421 in speed reduction ratio.

However, a gear train having a worm gear is relatively high in driving force transmission loss, and also, is likely to generate vibrations, and/or low frequency noises. It is after the sealing sheet 700 is completely taken up that an ordinary image forming operation begins. However, if the above-described gear train 421 continues to be driven, the vibrations and/or low frequency noises transmit to the development sleeve 221, making it possible for "banding" and the like image defects to occur. More specifically, the development sleeve 221 is for developing a latent image on the photosensitive drum 221. Thus, if the development sleeve 221 becomes unstable in rotation, or vibrates, the development process is undesirably affected. More concretely, "banding" or the like stripy image defects occur.

On the other hand, after the sealing sheet 700 is completely taken up, the portions of the gear train 421, which are on the downstream side of the gear 403 in terms of the drive force transmission, do not need to be rotated. Thus, from the standpoint of preventing the occurrence of the image defects attributable to the vibration or the like of the gear train 421, it is desired that after the sealing sheet 700 is completely taken up, the components of the gear train 421, which are on the downstream side of the driver gear 401, are not driven. In this embodiment, therefore, the developing device 220 is provided with a disconnecting mechanism 510, as a disconnecting means, which is for preventing the driving force from being transmitted to the take-up shaft 501 after the take-up shaft 501, as the sealing sheet removing means, is driven by a preset amount while the developing device 220 is driven for initialization.

[Structure for Stopping Driving Force Transmission]

Next, referring to FIGS. 8-14, the disconnecting mechanism 510 in this embodiment is described. As described above, the disconnecting mechanism 510 can prevent driving force from being transmitted to the take-up shaft 501 after the take-up shaft 501 is driven by a preset amount after the developing device 220 begins to be driven for initialization. Here, "preset amount" means an amount (number of revolutions or length of time) which is necessary for the take-up shaft 501 to be rotated to completely take up the sealing sheet sealing sheet 700. That is, the developing device 220 is structured so that the transmission of driving force to the take-up shaft 501 is stopped by the time the developer reaches one end of the development chamber 224 to the other, after the removal of the sealing sheet 700 from the developer passages 223*a* and 223*b*. In other words, the developing device 220 is structured so that the transmission of driving force to the take-up shaft 501 is stopped between when the sealing sheet 700 is completely taken up and when the first image begins to be formed.

Thus, the disconnecting mechanism 510 is provided with a holder 511 which holds the gear 403, worm gear 404, and driver gear 405, spring 513 as a pressure applying means, and a holding mechanism 514 as a holding means. By the way, FIG. 8 shows the abovementioned components including the holder 511, whereas FIG. 9 shows the abovementioned components excluding the holder 511. FIG. 10 is a perspective view of the disconnecting mechanism 510 as seen from the holder 511 side, and shows the gear trains held by the holder 511. Referring to FIG. 10, the holder 511 internally holds the gear 403, worm gear 404, and driver gear 405, in such a manner that preset amounts of distance are provided among the shafts by which these gears are supported, and also, that these gears are enabled to smoothly rotate while remaining meshed with each other.

The holder 511 is enabled to pivotally move about the rotational axis of the driver gear 405 while holding these three gears in such a manner that the positional relationship among the three gears remains unchanged. As described above, the driver gear 405 is for driving the take-up shaft 501, and is fixed to one end of the take-up shaft 501. Therefore, the holder 511 is pivotally movable about the rotational axis of the take-up shaft 501. Further, the holder 511 is under the pressure generated by the spring 513, as a pressure applying means, in the direction indicated by an arrow mark D in FIG. 8. More concretely, the spring 513 is extended between a part (for example, part of cover for gear train 421 and holder 511) and holder 511, and keeps the holder 511 pressured in the direction indicated by the arrow mark D. Thus, the holder 511 is enabled to pivotally move in the direction indicated by the arrow mark D.

The gear 403, which is the first rotational member held by the holder 511, can be meshed with, or unmeshed from, the driver gear 401. That is, until the transmission of driving force from the driver gear 401 to take-up shaft take-up shaft 501 is stopped, the gear 403 and driver gear 401 remain meshed with each other. When the transmission of driving force is to be stopped, the holder 511 is pivotally moved in the direction indicated by the arrow mark D by the resiliency of the spring 513. Thus, the gear 403 disengages from the driver gear 401, making it impossible for the driving force from the driver gear 401 to the gear 403. As a result, the driving of the take-up shaft 501 stops. In other words, the spring 513 keeps the gear 403 pressured in the direction to make it impossible for the driving force to be transmitted from the driver gear 401 to the gear 403. Thus, as the condition under which the holder 511 is kept in the position in which the holder 511 can allow driving force to be transmitted to the gear 403 is dissolved, the holder 511 pivotally moves in the direction of the arrow mark D, preventing thereby the driving force from being transmitted between the gear 403 and driver gear 401.

The holder 511 is held by the holding mechanism 514, as a holding means, in the transmitting position in which it allows the driver gear 401 to transmit the driving force to the gear 403 until the take-up shaft 501 is driven by the above-described preset amount. Therefore, the holding mechanism 514 is provided with a count gear 512, which is a rotational holding member which rotates with the take-up shaft 501, a rib 515 which is an engaging member, and a projection 516 which is a member to be engaged. The rib 515 is on one of the lateral surfaces of the count gear 512, and extends in the circumferential direction of the count gear 512. In terms of the circumferential direction of the count gear 512, the rib 515 has a gap 515A. The projection 516 is on the rear wall of the holder 511 which holds the gear 403. It is in contact with the inward surface of the rib 515, holding thereby the gear 403 in the above-described transmitting position. The rib 515 and projection 516 are structured so that as the take-up shaft 501 is driven by the above-described preset amount, and therefore, the count gear 512 rotates a preset number of times, the rib 515 and projection 516 disengage from each other.

To describe more concretely, the gap 515A of the rib 515 is positioned so that as the count gear 512 rotates the preset number of times, the gap 515A aligns with the projection 516. As for the holder 511 which holds the gear 403, it moves in such a manner that as the projection 516 aligns with the gap 515A, the projection 516 is moved through the gap 515A by the resiliency of the spring 513, and therefore, it becomes impossible for the driver gear 401 to transmit the driving force to the gear 403.

That is, while the projection 516 of the holder 511 is in engagement with the rib 515 of the count gear 512, the holder 511 is held in the position in which it keeps the gear 403 engaged with the driver gear 401, as shown in FIG. 9, in spite of the presence of the force generated by the resiliency of the spring 513. Here, the rib 515 is concentric with the count gear 512. Thus, as long as the projection 516 is in engagement with the rib 515, even if the count gear 512 rotates, the holder 511 does not pivotally move, or moves only by a negligible amount. In this embodiment, the gear 403 and driver gear 401 are positioned so that even if the holder 511 is pivotally moved by a small amount by the rotation of the count gear 512 while the projection 516 is in contact with the inward surface of the rib 515, the gear 403 and driver gear 401 smoothly rotate while remaining meshed with each other. Therefore, as driving force is inputted into the driver gear 401 while the developing device 220 is in the above-described state, the driving force is transmitted from the driver gear 401 to the driver gear 405 sequentially through the intermediary gears, that is, the gear 403 and worm gear 404.

On the other hand, as the count gear 512 rotates the preset number of times, and the gap 515A aligns with the projection 516, the projection 516 disengages from rib 515. Consequently, the holder 511 is pivotally moved by the resiliency of the spring 513, causing thereby the gear 403 and driver gear 401 to unmesh from each other. Here, the count gear 512 is in mesh with the counting tooth 405A (FIG. 10) which is an integral part of the driver gear 405. The driver gear 405 is provided with only one counting tooth 405A in terms of the rotational direction of the driver gear 405. Thus, each time the worm gear 404 fully rotates, the count gear 512 rotates by an amount equivalent to its single tooth. The worm gear 404 rotates with the take-up shaft 501, and therefore, the count gear 512 rotates with the take-up shaft 501. In this embodiment, as the take-up shaft 501 rotates by the above-described preset amount after driving force begins to be inputted into the developing device 220, the count gear 512 rotates by the preset number of times.

Then, as the projection 516 becomes disengaged from the rib 515, and the holder 511 pivotally moves in the direction of the arrow mark D as described above, the gear 403 becomes disengaged from the driver gear 401 as shown in FIG. 11. By the way, in this embodiment, the upstream end of the rib 515 (gap 515A) in terms of the rotational direction of the count gear 512 is provided with a slant surface 515B. As the rib 515 rotates, the slant surface 515B comes into contact with the projection 516, and guides the projection 516 in the direction parallel to the direction in which pressure is generated by the resiliency of the spring 513. Thus, it is ensured that as the count gear 512 rotates, the projection 516 and rib 515 disengage from each other.

When the developing device 220 is in the state shown in FIG. 11, driving force cannot be transmitted between the driver gear 401 and gear 403. Thus, even if the driver gear 401 continues to rotate, the gear 403 and its downstream rotational components do not rotate, and therefore, the driving force is not transmitted to the take-up shaft 501. Further, a part of the holder 511 is in contact with an unshown stopper, with which the developing means container 222 (for example, cover which covers gear train 421 and holder 511) is provided. Therefore, the holder 511 remains fixed in position.

FIG. 12 is a conceptualized block diagram of the system in this embodiment, which drives the take-up shaft 501 for taking up the sealing sheet 700, and then, stops the transmission of the driving force to the take-up shaft 501. In FIG. 12, the section of the system, which transmits driving force from the motor 400 to the driver gear 401 by way of the first screw 226, etc., is named as "driving force input section", and the direction in which driving force is transmitted is indicated by an arrow mark. The gear train 421 which transmits driving force from the driver gear 401 to the take-up shaft 501 is named "drive train".

The disconnecting mechanism 510 which includes holder 511 and count gear 512 is named "driving force transmission cessation mechanism". Further, the functional section which rotates the driver gear 405 by an amount equivalent to a single tooth of driver gear 405, with use of the projection 405A of driver gear 405, each time the driver gear 405 rotates one full turn is named "speed reducing means". Moreover, the combination of the rib 515, projection 516, and spring 513, which moves the holder 511 to separate the gear 403 from the driver gear 401 is named "separating means". The system which drives the take-up shaft 501 which includes the driver gear 405 is closed at the arrow mark which shows the driving force input direction. Further, the separation of the gear 403 from the driver gear 401 by the separating means is expressed by a switch symbol between "driving force input section" and "drive train". It is evident from FIG. 12 that the developing device 220 is structured so that as the "drive train" is disconnected by the "separating means", that is, as the "drive train" which is directly above the "driving force input section" in FIG. 12 is disconnected from the "driving force input section", the entirety of the sealing sheet take up mechanism, except for the "driving force input section" stops.

Next, referring to FIGS. 13 and 14, the above-described operation which drives the developing device 220 for initialization, takes up the sealing sheet 700, and stops transmitting driving force to the take-up shaft 501 is sequentially described. To begin with, when the developing device 220 is brand-new, the projection 516 and rib 515 are positioned as shown in part (a) of FIG. 14, and are in engagement with each other. Then, as driving force is inputted into the driver gear 401 to initialize the developing device 220 (S1), the gear train 421 begins to rotate (S2), and therefore, the take-up shaft 501 begins to rotate (S3). Thus, the sealing sheet 700 begins to be taken up by the take-up shaft 501 (S4). Meanwhile, the count gear 512 rotates at a slower speed than the take-up shaft 501. Eventually, the sealing sheet 700 is completely removed from the developer passages 223*a* and 223*b*.

Even after the sealing sheet 700 is completely taken up, the gear train 421 continues to rotate, causing thereby the count gear 512 to continue to rotate, until the relationship between the projection 516 and rib 515 becomes as shown in part (b) of FIG. 14. Then, as the count gear 512 rotates a preset amount (S5), the gap 515A of the rib 515 aligns with the direction, indicated by an arrow mark D in FIG. 14, in which pressure is generated by the resiliency of the spring 513 (S6). In this state, the projection 516 and gap 515A are in alignment with each other. Therefore, the projection 516 disengages from the rib 515 (S7). Thus, the holder 511 pivotally moves in the direction indicated by the arrow mark D about the rotational axis of the driver gear 405 (S8).

As the holder 511 pivotally moves, the distance between the shaft of the driver gear 401 and the shaft of the gear 403 increases, and therefore, the two gears driver gear 401 and gear 403 become unmeshed (S9). Consequently, the driving force is prevented from being transmitted to the gear 403 and the gears on the downstream side of the gear 403. Thus, the take-up shaft 501 stops rotating (S10). Further, the count gear 512 also stops rotating because the driver gear 405 stops rotating.

By the way, if the holder 511 fails to fully pivot for some reasons or the other, the count gear 512 continues to rotate, until the relationship between the slant surface 515B and projection 516 becomes as shown in part (d) of FIG. 14, in which the projection 516 is in contact with the slant surface 515B which is at one end of the rib 515. The slant surface 515B is long enough to engage with the projection 516 as the rib 515 (count gear 512) rotates, and is angled so that as the rib 515 rotates in contact with the projection 516, the slant surface 515B pushes the projection 516 in the direction indicated by the arrow mark D. That is, the system is structured so that even if the count gear 512 continues to rotate, the slant surface 515B presses the projection 516 in the direction indicated by the arrow mark D to cause the holder 511 to fully pivot to separate the gear 403 from the driver gear 401, in order to prevent the occurrence of malfunction.

As described above, in this embodiment, as the developing device 220 is driven for initialization, the take-up shaft 501 removes the sealing sheet 700. Therefore, the developing device 220 in this embodiment is shorter in setup procedure than any conventional developing device. Further, the developing device 220 is structured so that after the sealing sheet 700 is completely removed, the transmission of driving force to the take-up shaft 501 is prevented by the disconnecting mechanism 510. Therefore, it does not suffer from the vibrations and low frequency noises, which are attributable to the continuous rotations of the driver gear 405. Thus, it can prevent the occurrence of such image defects that are attributable to the above-described vibrations and low frequency noises.

<Embodiment 2>

Next, referring to FIG. 15, the second embodiment of the present invention is described. In the above-described first embodiment, the present invention was applied to the structure for removing the sealing sheet 700 which keeps sealed the developer passages 223*a* and 223*b* between the development chamber 224 and stirring chamber 225. In comparison, in this embodiment, the present invention is applied to the structure for removing a sealing sheet 800 which keeps sealed the developer outlet 311 through which the excessive amount of developer is trickled out of the developing device 220A. Otherwise, this embodiment is the same as the first embodiment, in particular, regarding the structure for removing the sealing sheet 800. Therefore, the structural components, portions thereof, etc., in this embodiment, which are the same as the counterparts in the first embodiment, are given the same referential codes as those given to the counterparts, and are not described, or very briefly described. That is, the description of this embodiment is concentrated to the difference of this embodiment from the first one.

Like the developing device 220 in the first embodiment, the developing device 220A in this embodiment is provided with a developer outlet 311 and 312 (FIG. 5). After the proper installation of the developing device 220 into the apparatus main assembly 100A, the outlet shutter 312 is in its open position. Thus, unless the developer outlet 311 remains sealed, the developer in the stirring chamber 225 passes by the return screw 229, and reaches the developer outlet 311. Therefore, it is possible that the developer will be unexpectedly discharged from the developing device 220. If the amount by which the developer is unexpectedly discharged is substantial, it is possible that while the developing device 220A is initialized after the image forming apparatus 100 is set up, the developing device 220A will become insufficient in the amount of developer. Thus, it is possible that the image forming apparatus 100 will output defective images. In other words, it is impossible to take full advantage of a developing device of the so-called trickle replenishment type, which is longer in service life.

In this embodiment, therefore, the developing device 220A is provided with the sealing sheet 800, as a sealing member, which is placed between the developer outlet 311 and outlet shutter 312 to keep the developer outlet 311 sealed when the developing device 220A is brand-new. Therefore, in a case where the image forming apparatus 100 is shipped, with the developing device 220A installed in the apparatus main assembly 100A, the developer outlet 311 remains sealed with the sealing sheet 800, which also is formed of thin film, like the sealing sheet 700 in the first embodiment. Referring to FIG. 15, the sealing sheet 800 is horizontally disposed between the developer outlet 311 and discharge screw 228 in a manner to keep the developer outlet 311 sealed within the developing device 220. The sealing sheet 800 is fixed to the sealing sheet seat 810 of the developing means container 222 with the use of such irreversible means as adhesive or welding. Thus, the developer outlet 311 remains sealed with sealing sheet 800 until the developing device 220 is driven for initialization.

The sealing sheet 800 has a long and narrow rectangular shape. It is removable from the developer outlet 311 by being taken up by the take-up shaft 501 as a sealing sheet removing means (means for taking up sealing sheet). Thus, the sealing sheet 800 is provided with a cover section 801 for covering the developer outlet 311, and a connective section 802 which is folded back at one end (left end in FIG. 15) of the cover section 801 and is connected to the take-up shaft 501. Thus, the take-up shaft 501 can remove the sealing sheet 800 from the developer outlet 311 by taking up the connective section 802, starting from the abovementioned end of the cover section 801. That is, the cover section 801 keeps the developer outlet 311 sealed by being fixed, from one end (right end in FIG. 15) to the other, to the sealing sheet seat sealing 810 which surrounds the developer outlet 311, with the use of welding or the like means. As for the connective section 802, one end is in connection to the right end of the cover section 801, and the other end is in connection to the take-up shaft 501, to which it is attached with the use of adhesive or the like. Therefore, as the take-up shaft 501 begins to rotate, the connective section 802 begins to be taken up, causing thereby the cover section 801 to be peeled away from the developer outlet 311, starting from the right end of the cover section cover section 801.

Also in this embodiment, the developing device 220 is structured so that the transmission of driving force to the take-up shaft 501 is stopped after the take-up shaft 501 is driven by a preset amount by the driving of the developing device 220A for initialization. The structure for transmitting driving force to the take-up shaft 501, and the structure for stopping the transmission of the take-up shaft 501, in this embodiment are the same as the counterparts in the first embodiment.

<Miscellanies>

In the foregoing, the first and second embodiments were individually described in terms of developing device structure. However, the structure in the first embodiment, and that in the second embodiment may be employed in combination. That is, a developing device may be structured so that both the sealing sheet 700 for keeping the developer passages 223*a* and 223*b* sealed, and the sealing sheet 800 for keeping the developer outlet 311 sealed, are removed by the take-up shaft 501.

Further, in the above-described first and second embodiments, the sealing member was a sealing sheet. However, it is not mandatory that the sealing member is in the form of a sheet of film. For example, the present invention is also applicable to a developing device which has a sealing member made up of a piece of thin plate as a shutter, and a connective piece of sheet attached to the thin plate, and which is structured so that as the connective piece of sheet is taken up, the piece of thin plate slides. Further, the means for removing the sealing member does not need to be such a means as the above-described one for taking up the sealing sheet. For example, a developing means may be structured so that the sealing member is made to slide as the developing device is driven.

Further, in the preceding embodiments described above, the developing devices were structured so that the removing means was driven by the driving of the first screw as a conveying member. However, the present invention is also applicable to a developing device structured so that its removing means is driven by the means for driving the development sleeve.

Further, in the above-described embodiments, the transmission of driving force to the removing means was stopped by increasing the distance between the shafts of the two gears. However, the present invention is also applicable to a developing device which employs a method different from the one in the first and second embodiment to stop the transmission of driving force to the removing means. For example, the present invention is also applicable to a developing device structured so that the gears are disengaged from each other by being moved in the direction parallel to their axes of rotation. For example, the present invention is compatible with a developing device structured as follows: the holder 511 is kept pressured in the direction parallel to the axial line of the driver gear 405, in the direction to be separated from the count gear 512. The holder 511 and the gear train held by the holder 511 are movable in this direction. Further, the projection of the holder 511 and the rib of the count gear 512 are shaped like a hook, for example. Thus, until the count gear 512 rotates a preset number of times, the projection and rib remain engaged with each other to keep the holder 511 in the position in which it keeps the gear 403 and driver gear 401 remain engaged with each other. Then, as the count gear 512 rotates the preset number of times, and therefore, the projection and rib disengage from each other, the gear 403 moves with the holder 511 in the direction parallel to its axial line. Consequently, the gear 403 and driver gear 405 disengage from each other.

Moreover, the structure for stopping the transmission of driving force to the removing means may be other structures than those in the preceding embodiments. For example, it is feasible to provide the gear train with a clutch to stop the transmission of driving force. In such a case, however, the gear for providing the gear train with the clutch continues to rotate, making it possible for the vibrations attributable to the rotation of this gear to have undesired effects. For example, it is possible to structure a developing device so that a pair of gears which are coaxial are disposed between the driver gear 401 and gear 403; one of the gears is engaged with the driver gear 401, and the other is engaged with the gear 403; and a clutch is provided between the pair of gears. In this case, as the transmission of driving force is stopped by the clutch, the other gear stops rotating, and therefore, driving force is not transmitted to the gear 403. However, as the driver gear 401 rotates, the gear which corresponds to the driver gear 401 rotates. Thus, as long as the developing device is driven, this gear which is used only for removing the sealing member continues to rotate, making it possible for the vibrations attributable to the rotation of this gear to have ill effects. This is why it is desirable to structure a developing device so that the transmission of driving force is stopped by separating the two gears from each other as in the preceding embodiments.

Further, the structural components for transmitting driving force do not need to be limited to the above-described gears. For example, driving force may be transmitted with the use of frictional wheels, or a combination of pulleys and a belt.

Further, a developing device does not need to be structured as described above; it may be differently structured. In the above-described embodiments, the development chamber and stirring chamber are disposed so that they are disposed side by side at roughly the same level, and also, so that the developer is horizontally stirred. However, the present invention is also applicable to a developing device, the development chamber and stirring chamber of which are vertically stacked in parallel so that the developer is vertically stirred. Further, in the above-described embodiments, it was in the development chamber that the developer is supplied to the development sleeve, and then, is recovered from the development sleeve. However, the present invention is also applicable to a developing device of the so-called mono-function type, which is structured so that developer is supplied to the development sleeve in the development chamber, and is removed from the development sleeve in the stirring chamber.

Moreover, in the above-described embodiments, the outlet through which developer is discharged was positioned at the bottom of the developing device. However, the present invention is also applicable to a developing device, the developer outlet of which extends in the horizontal direction. Further, regarding the structure for discharging the developer, not only is the present invention applicable to a developing device structured so that it discharges the developer which passed by the return screw, but also, to a developing device structured so that it allows the developer to overflow through the developer outlet attached to the developing means container at a preset level.

According to the present invention, as the developing device is driven for initialization, the removing means removes the sealing member. Then, after the removal of the sealing member, the transmission of driving force to the removing means is stopped by the disconnecting means. Thus, the present invention can reduce in length the procedure to set up the device, and also, can contribute to the prevention of the occurrence of image defects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-193627 filed on Sep. 24, 2014, which is hereby incorporated by reference herein in its entirety.

What is claimed is:

1. A developing apparatus detachably mountable to an image forming apparatus, comprising:

a developer container for accommodating a developer;

a sealing member configured to unsealably seal said developer container to retain an initial developer therein;

a driven member configured to receive a drive to unseal said developer container;

a feeding member configured to feed the developer in said developer container;

a developer carrying member configured to develop a latent image with a developer carried on a surface thereof; and a disconnecting mechanism configured to disconnect the drive to said driven member, said disconnecting mechanism being movable between a drive transmission position in which the drive is capable of being transmitted from a motor, which is provided on the image forming apparatus to drive said feeding member or said developer carrying member, to said driven member and a non-driving position in which the drive is not transmitted from the motor, said disconnecting mechanism including, an urging member configured to urge said disconnecting mechanism toward the non-driving position; and a holding mechanism capable of holding said disconnecting mechanism in the drive transmission position, wherein said holding mechanism is movable from a position for holding said disconnecting mechanism in the drive transmission position to a position for releasing said disconnecting mechanism from the drive transmission position, by a drive from said disconnecting mechanism placed in the drive transmission position, and wherein said disconnecting mechanism includes a driving train having a first gear engaged with a driving gear configured to drive said feeding member, a worm gear engaged with said first gear, and a second gear configured to drive said driven member, and a holder configured to support said driving train so as to be integrally swingable about a rotational axis of said driving gear while keeping relative positions between said first gear, said worm gear and said second gear, wherein said disconnecting mechanism disengages between said first gear and said driving gear.

2. An apparatus according to claim 1, wherein said holding mechanism includes a holding rotatable member provided rotatably together with said driven member, and an engaging portion provided on said holding rotatable member and disengageably engaging with said disconnecting mechanism so as to hold said disconnecting mechanism in the drive transmission position.

3. An apparatus according to claim 2, wherein said disconnecting mechanism includes a portion-to-be-engaged engaged with said engaging portion, and a guide portion provided on said holding rotatable member and capable of guiding said portion-to-be-engaged in a releasing direction so that when said holding rotatable member is rotated through a predetermined amount, the engagement of said engaging portion is released.

4. An apparatus according to claim 3, wherein said engaging portion includes a rib extending a part of said holding rotatable member along a circumferential direction, and said portion-to-be-engaged includes a projection engaged with said rib, and wherein a portion not having said rib is disposed at a phase position where said projection is placed when said holding rotatable member is rotated through a predetermined amount, and when said holding rotatable member is placed in the phase position, said disconnecting mechanism moves from the drive transmission position to the non-driving position by the urging force of said urging member.

5. An apparatus according to claim 4, wherein said rib is provided at a downstream end portion with respect to a rotational moving direction of said holding rotatable member with an inclined surface for engaging with said projection with rotation of said holding rotatable member to guide said projection in an urging direction of said urging member.

6. An image forming apparatus, comprising:

an image bearing member;

a motor transmitting a drive force; and a developing device including, a developer container for accommodating a developer, a sealing member configured to unsealably seal said developer container to retain an initial developer therein, a driven member configured to receive a drive to unseal said developer container, a feeding member configured to feed the developer in said developer container, a developer carrying member configured to develop a latent image formed on said image bearing member, with a developer carried on a surface thereof, and a disconnecting mechanism configured to disconnect the drive to said driven member, said disconnecting mechanism being movable between a drive transmission position in which the drive is capable of being transmitted from said motor, which drives said feeding member or said developing carrying member, to said driven member and a non-driving position in which the drive is not transmitted from said motor, said disconnecting mechanism including, an urging member configured to urge said disconnecting mechanism toward the non-driving position, and a holding mechanism capable of holding said disconnecting mechanism in the drive transmission position, wherein said holding mechanism is movable from a position for holding said disconnecting mechanism in the drive transmission position to a position for releasing said disconnecting mechanism from the drive transmission position, by a drive from said disconnecting mechanism placed in the drive transmission position, wherein said disconnecting mechanism includes a driving train having a first gear engaged with a driving gear configured to drive said feeding member, a worm gear engaged with said first gear, and a second gear configured to drive said driven member, and a holder configured to support said driving train so as to be integrally swingable about a rotational axis of said driving gear while keeping relative positions between said first gear, said worm gear and said second gear, wherein said disconnecting mechanism disengages between said first gear and said driving gear, wherein an image forming operation of said image forming apparatus is permitted after a drive input to said non-driving member is disconnected by said disconnecting mechanism.

7. An apparatus according to claim 6, wherein said holding mechanism includes a holding rotatable member provided rotatably together with said driven member, and an engaging portion provided on said holding rotatable member and disengageably engaging with said disconnecting mechanism so as to hold said disconnecting mechanism said in the drive transmission position.

8. An apparatus according to claim 7, wherein said disconnecting mechanism includes a portion-to-be-engaged engaged with said engaging portion, and a guide portion provided on said holding rotatable member and capable of guiding said portion-to-be-engaged in a releasing direction so that when said holding rotatable member is rotated through a predetermined amount, the engagement of said engaging portion is released.

9. An apparatus according to claim 8, wherein said engaging portion includes a rib extending a part of said holding rotatable member along a circumferential direction, and said portion-to-be-engaged includes a projection engaged with said rib, and wherein a portion not having said rib is disposed at a phase position where said projection is placed when said holding rotatable member is rotated through a predetermined amount, and when said holding rotatable member is placed in the phase position, said disconnecting mechanism moves from the drive transmission position to the non-driving position by the urging force of said urging member.

10. An apparatus according to claim 9, wherein said rib is provided at a downstream end portion with respect to a rotational moving direction of said holding rotatable member with an inclined surface for engaging with said projection with rotation of said holding rotatable member to guide said projection in an urging direction of said urging member.

11. A developing apparatus detachably mountable to an image forming apparatus, comprising:

a developer container for accommodating a developer;

a sealing member configured to unsealably seal said developer container to retain an initial developer therein;

a driven member configured to receive a drive to unseal said developer container;

a feeding member configured to feed the developer in said developer container;

a developer carrying member configured to develop a latent image with a developer carried on a surface thereof; and a disconnecting mechanism configured to disconnect the drive to said driven member, said disconnecting mechanism being movable between a drive transmission position in which the drive is capable of being transmitted from a motor, which is provided on the image forming apparatus to drive said feeding member or said developer carrying member, to said driven member and a non-driving position in which the drive is not transmitted from said motor, said disconnecting mechanism including, an urging member configured to urge said disconnecting mechanism toward the non-driving position; and a holding mechanism capable of holding said disconnecting mechanism in the drive transmission position, wherein said holding mechanism is movable from a position for holding said disconnecting mechanism in the drive transmission position to a position for releasing said disconnecting mechanism from the drive transmission position, by a drive from said disconnecting mechanism placed in the drive transmission position, wherein said holding mechanism includes a holding rotatable member provided rotatably together with said driven member, and an engaging portion provided on said holding rotatable member and disengageably engaging with said disconnecting mechanism so as to hold said disconnecting mechanism in the drive transmission position, wherein said disconnecting mechanism includes a portion-to-be-engaged engaged with said engaging portion, and a guide portion provided on said holding rotatable member and capable of guiding said portion-to-be-engaged in a releasing direction so that when said holding rotatable member is rotated through a predetermined amount, the engagement of said engaging portion is released, and wherein said engaging portion includes a rib extending a part of said holding rotatable member along a circumferential direction, and said portion-to-be-engaged includes a projection engaged with said rib, and wherein a portion not having said rib is disposed at a phase position where said projection is placed when said holding rotatable member is rotated through a predetermined amount, and when said holding rotatable member is placed in the phase position, said disconnecting mechanism moves from the drive transmission position to the non-driving position by the urging force of said urging member.

* * * * *